US008602242B2

(12) United States Patent
Sanfilippo et al.

(10) Patent No.: US 8,602,242 B2
(45) **Date of Patent: *Dec. 10, 2013**

(54) FLEXIBLE, STACKABLE CONTAINER USED FOR STORING A QUANTITY OF PRODUCT AND METHOD FOR MANUFACTURING SAME

(75) Inventors: John E. Sanfilippo, Barrington Hills, IL (US); James J. Sanfilippo, Barrington Hills, IL (US); Jeanne M. Skaggs, Arlington Heights, IL (US); Roy Speer, Barrington, IL (US)

(73) Assignee: Clear Lam Packaging, Inc., Elk Grove Village, IL (US)

( * ) Notice: Subject to any disclaimer, the term of this patent is extended or adjusted under 35 U.S.C. 154(b) by 696 days.

This patent is subject to a terminal disclaimer.

(21) Appl. No.: 12/614,201

(22) Filed: Nov. 6, 2009

(65) Prior Publication Data

US 2010/0140129 A1 Jun. 10, 2010

Related U.S. Application Data

(60) Provisional application No. 61/111,896, filed on Nov. 6, 2008, provisional application No. 61/111,874, filed on Nov. 6, 2008.

(51) Int. Cl.
*B65D 6/16* (2006.01)
*B65D 30/16* (2006.01)

(52) U.S. Cl.
USPC ..... 220/6; 229/103.3; 383/104; 383/119; 383/120; 383/122

(58) Field of Classification Search
USPC ..... 220/6, 270, 256.1, 258.1, 258.3, 220/359.2–359.4; 229/125.05, 125.09, 229/125.13, 125.15, 125.17, 103.3, 104, 229/117.03, 117.05, 212, 221–234; 383/61.1, 67, 78, 80, 93, 95, 96, 104, 383/119, 120, 122, 41
See application file for complete search history.

(56) References Cited

U.S. PATENT DOCUMENTS

| | | | |
|---|---|---|---|
| 724,316 | A | 3/1903 | Staples |
| 1,102,750 | A | 7/1914 | Hawkins |

(Continued)

FOREIGN PATENT DOCUMENTS

| | | |
|---|---|---|
| EP | 0879767 | 11/1998 |
| EP | 1106508 | 6/2001 |

(Continued)

OTHER PUBLICATIONS

International Search Report and Written Opinion for corresponding International Application No. PCT/US2009/063591, dated Jun. 18, 2010.

(Continued)

*Primary Examiner* — J. Gregory Pickett
*Assistant Examiner* — Ned A Walker
(74) *Attorney, Agent, or Firm* — Marshall, Gerstein & Borun LLP

(57) ABSTRACT

A flexible, stackable container for storing a quantity of a product includes a sealed package that is formed from a single sheet of film having oppositely disposed lateral edges. The package includes a first panel and outwardly extending corner seals that border more than two sides of the first panel, a second panel disposed opposite the first panel and having an end seal, and four lateral sides disposed between the first and second panels. The second panel is formed by tucking portions of the lateral sides proximate the lateral edges inwardly and sealing portions of the film proximate the lateral edges together to form an end seal, the end seal being folded over towards an outer surface of the package.

11 Claims, 28 Drawing Sheets

(56) References Cited

U.S. PATENT DOCUMENTS 1,389,197 A 8/1921 Kusterer
1,395,229 A 10/1921 Inman et al.
1,747,618 A 2/1930 Burns
1,930,285 A 10/1933 Robinson
2,017,176 A * 10/1935 Andrews ..... 229/131.1
2,041,227 A * 5/1936 Chalmers ..... 229/87.08
2,048,122 A * 7/1936 Howard ..... 383/108
2,092,858 A * 9/1937 Richard ..... 493/189
2,106,907 A 2/1938 Brunt et al.
2,113,431 A 4/1938 Milliken
2,153,310 A 4/1939 Newman
2,180,841 A * 11/1939 Vogt ..... 383/210
2,239,398 A 4/1941 Palmer
2,251,283 A 8/1941 Johnson
2,259,866 A 10/1941 Stokes
2,291,063 A 7/1942 Staude et al.
2,311,857 A 2/1943 Noah
2,328,579 A * 9/1943 Pelosi ..... 229/5.5
2,330,015 A 9/1943 Stokes
2,352,766 A * 7/1944 Bogue ..... 229/203
2,365,159 A 12/1944 Walton
2,385,898 A * 10/1945 Waters ..... 229/117.03
2,416,332 A 2/1947 Lehman
2,495,807 A 1/1950 Buttery
2,508,962 A * 5/1950 Moore ..... 383/122
2,524,766 A * 10/1950 Carroll ..... 229/5.5
2,619,226 A * 11/1952 Adams ..... 221/63
2,684,807 A 7/1954 Gerrish
2,695,847 A 11/1954 Fisher
2,719,663 A 10/1955 Meyer-Jagenberg
2,737,338 A 3/1956 Moore
2,749,245 A 6/1956 Peters
2,750,093 A 6/1956 Moore
2,758,775 A 8/1956 Moore
2,787,410 A 4/1957 Moore
2,864,710 A 12/1958 Pottle et al.
2,936,940 A * 5/1960 Berghgracht ..... 383/104
2,970,735 A 2/1961 Jacke
3,006,257 A * 10/1961 Orsini ..... 493/202
3,054,550 A 9/1962 Comstock
3,111,223 A 11/1963 Jacobi
3,116,153 A 12/1963 Seiferth et al.
3,125,275 A 3/1964 Ehe
3,127,082 A * 3/1964 Meyer-Jagenberg ..... 229/123.3
3,143,276 A 8/1964 Nichols
3,155,304 A 11/1964 Beerend
3,172,769 A 3/1965 Horan
3,185,379 A 5/1965 Kohlhaas
3,206,094 A 9/1965 Humphrey
3,228,584 A * 1/1966 Ashton ..... 383/203
3,235,168 A 2/1966 Nichols
3,249,286 A 5/1966 Palmer
3,259,303 A * 7/1966 Repko ..... 383/203
3,272,423 A 9/1966 Bjarno
3,275,214 A 9/1966 Carangelo
3,299,611 A 1/1967 Hendrick et al.
3,314,591 A * 4/1967 Cheeley ..... 383/94
3,318,204 A 5/1967 Crane
3,325,077 A 6/1967 Boegershausen
3,326,097 A 6/1967 Lokey
3,339,721 A 9/1967 Goldstein
3,349,959 A * 10/1967 Watkins ..... 221/48
3,380,646 A * 4/1968 Doyen et al. ..... 383/104
3,423,007 A 1/1969 Christensson
3,426,499 A * 2/1969 Paige ..... 53/451
3,434,652 A * 3/1969 Shore ..... 383/104
3,437,258 A * 4/1969 Kugler ..... 383/104
3,462,067 A * 8/1969 Shore ..... 383/104
3,505,779 A * 4/1970 Kopp ..... 53/550
3,515,270 A 6/1970 Yang et al.
3,521,807 A 7/1970 Weisberg
3,562,392 A 2/1971 Mylius
3,599,387 A 8/1971 James
3,604,491 A * 9/1971 Spiess ..... 383/80
3,621,637 A 11/1971 Sternau
3,738,567 A * 6/1973 Ruda ..... 383/75
3,739,977 A * 6/1973 Shapiro et al. ..... 383/104
3,785,112 A * 1/1974 Leasure et al. ..... 53/451
3,838,787 A 10/1974 McCloskey
3,935,993 A * 2/1976 Doyen et al. ..... 383/94
3,940,054 A * 2/1976 Goebel et al. ..... 206/449
3,968,921 A 7/1976 Jewell
3,980,225 A * 9/1976 Kan ..... 383/104
4,041,851 A * 8/1977 Jentsch ..... 493/200
4,069,348 A 1/1978 Bush
4,082,214 A 4/1978 Baker
4,101,051 A * 7/1978 Reil ..... 229/215
4,129,976 A * 12/1978 Grundler et al. ..... 53/552
4,192,420 A 3/1980 Worrell, Sr. et al.
4,197,949 A * 4/1980 Carlsson ..... 229/229
4,260,061 A 4/1981 Jacobs
4,291,826 A 9/1981 Swanson
4,308,679 A * 1/1982 Ray et al. ..... 40/312
4,338,766 A 7/1982 Hamilton
4,345,133 A 8/1982 Cherney et al.
4,345,393 A * 8/1982 Price et al. ..... 40/312
D266,049 S 9/1982 Conti
4,353,497 A * 10/1982 Bustin ..... 383/104
4,361,266 A 11/1982 Killy
4,367,842 A 1/1983 Rausing
4,420,080 A 12/1983 Nakamura
4,441,648 A 4/1984 Portsmouth
4,554,190 A 11/1985 McHenry et al.
4,589,145 A 5/1986 Van Erden et al.
4,621,000 A 11/1986 Frick
4,651,874 A 3/1987 Nakamura
4,663,915 A 5/1987 Van Erden et al.
4,674,129 A 6/1987 Janhonen
4,679,693 A 7/1987 Forman
4,679,701 A 7/1987 Ackermann et al.
4,696,404 A 9/1987 Corella
4,786,192 A 11/1988 Graves et al.
4,790,436 A * 12/1988 Nakamura ..... 206/449
4,798,295 A 1/1989 Rausing
4,804,137 A 2/1989 Harby
4,808,421 A 2/1989 Mendenhall et al.
4,837,849 A 6/1989 Erickson et al.
4,840,270 A 6/1989 Caputo et al.
4,848,575 A * 7/1989 Nakamura et al. ..... 206/449
4,851,246 A * 7/1989 Maxwell et al. ..... 426/107
4,881,360 A 11/1989 Konzal et al.
4,886,373 A 12/1989 Corella
4,909,017 A 3/1990 McMahon et al.
4,954,124 A 9/1990 Erickson et al.
4,986,054 A 1/1991 McMahon
4,997,416 A 3/1991 Mitchell et al.
5,031,826 A 7/1991 Seufert
5,036,997 A 8/1991 May et al.
5,044,777 A * 9/1991 Watkins et al. ..... 383/100
5,046,300 A 9/1991 Custer et al.
5,059,036 A * 10/1991 Richison et al. ..... 383/61.2
5,062,527 A 11/1991 Westerman
5,065,887 A 11/1991 Schuh et al.
5,078,509 A 1/1992 Center et al.
5,080,643 A 1/1992 Mitchell et al.
5,092,831 A 3/1992 James et al.
5,127,208 A 7/1992 Custer et al.
5,158,371 A * 10/1992 Moravek ..... 383/104
5,158,499 A 10/1992 Guckenberger
5,195,829 A 3/1993 Watkins et al.
5,205,651 A * 4/1993 Decottignies et al. ..... 383/119
5,215,380 A 6/1993 Custer et al.
5,251,809 A 10/1993 Drummond et al.
5,254,073 A * 10/1993 Richison et al. ..... 493/195
5,255,497 A 10/1993 Zoromski et al.
5,350,240 A 9/1994 Billman et al.
D351,090 S 10/1994 Narsutis
5,352,466 A 10/1994 Delonis
5,353,946 A 10/1994 Behrend
5,356,069 A * 10/1994 Bochet et al. ..... 229/104
D354,436 S 1/1995 Krupa
5,417,035 A 5/1995 English
D364,563 S 11/1995 Miller et al.
5,498,080 A * 3/1996 Dalea et al. ..... 383/120

(56) References Cited

U.S. PATENT DOCUMENTS 5,505,305 A 4/1996 Scholz et al.
5,542,902 A * 8/1996 Richison et al. ..... 493/195
5,545,420 A 8/1996 Lipinski et al.
D374,774 S 10/1996 Cassel
5,561,966 A 10/1996 English
5,611,452 A 3/1997 Bonora et al.
5,613,608 A * 3/1997 Tronchetti et al. ..... 206/494
5,655,706 A 8/1997 Vandiver
D386,001 S 11/1997 Saffran
5,687,848 A 11/1997 Scholz et al.
5,704,480 A 1/1998 Scholz et al.
5,704,541 A 1/1998 Mogard
D394,606 S 5/1998 Zorn et al.
5,749,512 A 5/1998 Gingras-Taylor
5,770,839 A * 6/1998 Ruebush et al. ..... 219/727
5,772,332 A * 6/1998 Geller ..... 383/119
D395,952 S 7/1998 Buczwinski et al.
5,785,179 A 7/1998 Buczwinski et al.
5,788,121 A * 8/1998 Sasaki et al. ..... 222/105
5,788,378 A 8/1998 Thomas
5,789,049 A 8/1998 Randles
5,791,465 A * 8/1998 Niki et al. ..... 206/210
5,799,863 A * 9/1998 Capy et al. ..... 229/104
5,818,016 A 10/1998 Lorence et al.
5,820,017 A 10/1998 Eliovson et al.
5,826,401 A * 10/1998 Bois ..... 53/412
5,842,790 A * 12/1998 Imer ..... 383/122
5,857,613 A 1/1999 Drummond et al.
5,858,543 A 1/1999 Futter et al.
5,862,652 A * 1/1999 Schoeler ..... 53/551
5,882,749 A 3/1999 Jones et al.
5,882,789 A 3/1999 Jones et al.
5,897,050 A 4/1999 Barnes
D409,484 S 5/1999 Tasker
5,908,246 A 6/1999 Arimura et al.
D412,439 S 8/1999 Cormack
5,937,615 A 8/1999 Forman
5,944,425 A 8/1999 Forman
5,972,396 A 10/1999 Jurgovan et al.
5,983,594 A 11/1999 Forman
5,993,593 A 11/1999 Swartz et al.
6,005,234 A * 12/1999 Moseley et al. ..... 219/727
6,021,624 A * 2/2000 Richison et al. ..... 53/410
6,023,914 A * 2/2000 Richison et al. ..... 53/410
6,026,953 A * 2/2000 Nakamura et al. ..... 206/233
D421,901 S 3/2000 Hill
D421,902 S 3/2000 Hill
6,036,365 A * 3/2000 Imer ..... 383/104
6,038,839 A 3/2000 Linkiewicz
6,056,141 A 5/2000 Navarini et al.
6,060,096 A 5/2000 Hanson et al.
D427,056 S * 6/2000 Irace et al. ..... D9/713
6,113,271 A * 9/2000 Scott et al. ..... 383/211
6,120,183 A * 9/2000 Buchanan et al. ..... 383/122
6,132,351 A 10/2000 Lotto et al.
6,137,098 A * 10/2000 Moseley et al. ..... 219/727
6,139,662 A 10/2000 Forman
6,149,304 A * 11/2000 Hamilton et al. ..... 383/62
D437,686 S 2/2001 Balzar et al.
6,182,887 B1 2/2001 Ljunstrom et al.
6,231,237 B1 5/2001 Geller
6,234,676 B1 5/2001 Galomb et al.
6,245,367 B1 6/2001 Galomb
6,250,048 B1 6/2001 Linkiewicz
6,253,993 B1 7/2001 Lloyd et al.
6,254,907 B1 7/2001 Galomb
6,261,215 B1 * 7/2001 Imer ..... 493/210
D446,014 S 8/2001 Adkins
6,273,610 B1 * 8/2001 Koyama et al. ..... 383/207
6,274,181 B1 * 8/2001 Richison et al. ..... 426/118
6,309,105 B1 10/2001 Palumbo
D450,960 S 11/2001 Boyea et al.
6,319,184 B1 11/2001 DeMatteis et al.
D452,374 S 12/2001 Kim
6,325,239 B2 * 12/2001 Randall et al. ..... 220/835
6,350,057 B1 2/2002 Forman
6,354,062 B1 3/2002 Haughton et al.
6,361,212 B1 3/2002 Sprehe et al.
6,420,006 B1 7/2002 Scott
6,423,356 B2 * 7/2002 Richison et al. ..... 426/118
D461,403 S 8/2002 Chomik et al.
6,428,867 B1 8/2002 Scott et al.
6,430,899 B1 8/2002 Cicha
6,431,434 B1 8/2002 Haughton et al.
D463,276 S 9/2002 Piscopo et al.
6,446,796 B1 * 9/2002 Schmidt ..... 206/232
D464,884 S 10/2002 Sumpmann et al.
6,481,183 B1 11/2002 Schmidt
D466,807 S 12/2002 Buck et al.
6,502,986 B1 1/2003 Bensur et al.
6,510,673 B1 * 1/2003 Visona' et al. ..... 53/451
6,513,308 B1 * 2/2003 Meeuwesen et al. ..... 53/551
D471,804 S 3/2003 Staples
6,533,456 B1 3/2003 Buchman
D473,461 S 4/2003 Joubert
6,568,150 B2 5/2003 Forman
6,589,622 B1 7/2003 Scott
6,615,567 B2 9/2003 Kuhn et al.
6,659,645 B1 * 12/2003 Schulz ..... 383/210
D485,461 S 1/2004 Sams et al.
6,679,034 B2 * 1/2004 Kohl et al. ..... 53/551
6,695,757 B2 * 2/2004 Edwards et al. ..... 493/51
D487,192 S 3/2004 Farnham et al.
6,719,140 B1 4/2004 Rinsler
6,719,678 B1 4/2004 Stern
D489,530 S 5/2004 Lindsay
6,729,112 B2 5/2004 Kuss et al.
6,736,309 B1 5/2004 Westerman et al.
6,746,388 B2 * 6/2004 Edwards et al. ..... 493/51
6,755,927 B2 6/2004 Forman
6,761,279 B1 7/2004 Martin et al.
6,783,277 B2 * 8/2004 Edwards et al. ..... 383/104
6,817,160 B2 11/2004 Schmidt
6,820,391 B2 11/2004 Barmore et al.
D501,134 S 1/2005 Takahashi et al.
6,845,602 B2 * 1/2005 Drut ..... 53/551
D503,336 S 3/2005 Tucker et al.
D504,622 S 5/2005 Takahashi et al.
6,886,313 B2 5/2005 Knoerzer et al.
6,913,389 B2 7/2005 Kannankeril et al.
6,918,532 B2 * 7/2005 Sierra-Gomez et al. ... 229/87.08
6,935,086 B2 8/2005 Brenkus et al.
6,953,069 B2 10/2005 Galomb
D513,870 S 1/2006 Rosine et al.
6,986,920 B2 1/2006 Forman et al.
7,059,466 B2 6/2006 Lees et al.
7,077,259 B2 7/2006 Breidenbach
7,080,726 B2 7/2006 Breidenbach et al.
D528,010 S * 9/2006 Yashima et al. ..... D9/702
7,108,441 B2 9/2006 Altonen et al.
7,128,200 B2 10/2006 Lees et al.
D531,894 S 11/2006 Ramirez et al.
7,153,026 B2 12/2006 Galomb
7,156,556 B2 1/2007 Takahashi et al.
RE39,505 E 3/2007 Thomas et al.
7,205,016 B2 4/2007 Garwood
7,207,717 B2 4/2007 Steele
7,213,710 B2 * 5/2007 Cotert ..... 206/494
D544,762 S 6/2007 Zimmerman
D545,186 S 6/2007 Liebe et al.
D548,080 S 8/2007 Brown et al.
D552,468 S 10/2007 Seum et al.
7,299,608 B2 * 11/2007 Kohl et al. ..... 53/551
7,350,688 B2 4/2008 Sierra-Gomez et al.
7,371,008 B2 5/2008 Bonenfant
D571,146 S 6/2008 Sanfilippo et al.
D571,197 S * 6/2008 Sanfilippo et al. ..... D9/420
D591,555 S * 5/2009 Sanfilippo et al. ..... D7/391
D608,193 S * 1/2010 Sanfilippo et al. ..... D9/420
7,665,629 B2 * 2/2010 Julius et al. ..... 221/63
7,665,895 B2 * 2/2010 Takita et al. ..... 383/88
7,744,517 B2 6/2010 Bonenfant
7,780,006 B2 * 8/2010 Clark et al. ..... 206/494
7,993,256 B2 * 8/2011 Takita et al. ..... 493/215

(56) References Cited

U.S. PATENT DOCUMENTS

| | | | | |
|---|---|---|---|---|
| 8,006,833 | B2 * | 8/2011 | Clark et al. | 206/223 |
| 8,038,349 | B2 * | 10/2011 | Andersson et al. | 383/205 |
| 8,066,137 | B2 * | 11/2011 | Sanfilippo et al. | 220/6 |
| 8,132,395 | B2 * | 3/2012 | Gehring et al. | 53/451 |
| 8,182,891 | B2 | 5/2012 | Scott et al. | |
| 8,231,024 | B2 * | 7/2012 | Sanfilippo et al. | 220/6 |
| 8,276,353 | B2 * | 10/2012 | Reaves et al. | 53/551 |
| 8,308,363 | B2 | 11/2012 | Vogt et al. | |
| 2001/0005979 | A1 * | 7/2001 | Kuss et al. | 53/551 |
| 2001/0010253 | A1 | 8/2001 | Forman | |
| 2002/0009575 | A1 | 1/2002 | DeMatteis | |
| 2002/0090879 | A1 | 7/2002 | Galomb | |
| 2002/0094922 | A1 * | 7/2002 | Edwards et al. | 493/221 |
| 2002/0118896 | A1 | 8/2002 | Forman | |
| 2002/0144998 | A1 | 10/2002 | Lees et al. | |
| 2002/0147088 | A1 | 10/2002 | Edwards | |
| 2003/0001002 | A1 | 1/2003 | Haughton et al. | |
| 2003/0041564 | A1 | 3/2003 | Schmidt | |
| 2003/0054929 | A1 | 3/2003 | Post et al. | |
| 2003/0059130 | A1 * | 3/2003 | Yoneyama et al. | 383/10 |
| 2003/0063820 | A1 | 4/2003 | Buchman | |
| 2003/0100424 | A1 | 5/2003 | Barmore et al. | |
| 2003/0111523 | A1 | 6/2003 | Haugan | |
| 2003/0152679 | A1 | 8/2003 | Garwood | |
| 2003/0165602 | A1 | 9/2003 | Garwood | |
| 2003/0170357 | A1 | 9/2003 | Garwood | |
| 2003/0170359 | A1 | 9/2003 | Garwood | |
| 2003/0175392 | A1 | 9/2003 | Garwood | |
| 2003/0185937 | A1 | 10/2003 | Garwood | |
| 2003/0185948 | A1 | 10/2003 | Garwood | |
| 2004/0025476 | A1 | 2/2004 | Oliverio et al. | |
| 2004/0031244 | A1 | 2/2004 | Steele | |
| 2004/0040261 | A1 | 3/2004 | Troyer et al. | |
| 2004/0058103 | A1 | 3/2004 | Anderson et al. | |
| 2004/0081729 | A1 | 4/2004 | Garwood | |
| 2004/0089578 | A1 * | 5/2004 | Lin | 206/494 |
| 2004/0105600 | A1 | 6/2004 | Floyd | |
| 2004/0114838 | A1 | 6/2004 | McGregor | |
| 2004/0120611 | A1 | 6/2004 | Kannankeril et al. | |
| 2004/0146602 | A1 | 7/2004 | Garwood et al. | |
| 2004/0185154 | A1 | 9/2004 | Garwood | |
| 2004/0185155 | A1 | 9/2004 | Garwood | |
| 2004/0185156 | A1 | 9/2004 | Garwood | |
| 2004/0188457 | A1 | 9/2004 | Galomb | |
| 2004/0226625 | A1 | 11/2004 | Galomb | |
| 2004/0226849 | A1 | 11/2004 | Brenkus et al. | |
| 2004/0251163 | A1 | 12/2004 | Conde et al. | |
| 2004/0262322 | A1 | 12/2004 | Middleton et al. | |
| 2005/0011906 | A1 | 1/2005 | Buck et al. | |
| 2005/0031233 | A1 | 2/2005 | Varanese et al. | |
| 2005/0053315 | A1 | 3/2005 | Aasen | |
| 2005/0069227 | A1 | 3/2005 | Steele | |
| 2005/0069230 | A1 | 3/2005 | Takahashi et al. | |
| 2005/0139645 | A1 | 6/2005 | Shean et al. | |
| 2005/0150785 | A1 | 7/2005 | Julius et al. | |
| 2005/0189367 | A1 | 9/2005 | Chasid et al. | |
| 2005/0208188 | A1 | 9/2005 | Garwood | |
| 2005/0238766 | A1 | 10/2005 | Henderson et al. | |
| 2005/0265636 | A1 | 12/2005 | Michalsky | |
| 2005/0276525 | A1 | 12/2005 | Hebert et al. | |
| 2006/0006049 | A1 | 1/2006 | Breidenbach et al. | |
| 2006/0016865 | A1 | 1/2006 | Berglin et al. | |
| 2006/0076352 | A1 | 4/2006 | Peterson et al. | |
| 2006/0080944 | A1 | 4/2006 | Annehed et al. | |
| 2006/0113212 | A1 | 6/2006 | Steele | |
| 2006/0169691 | A1 | 8/2006 | Rothschild et al. | |
| 2006/0210202 | A1 | 9/2006 | Plourde | |
| 2006/0283750 | A1 | 12/2006 | Villars et al. | |
| 2007/0080078 | A1 | 4/2007 | Hansen et al. | |
| 2007/0082096 | A1 | 4/2007 | Dougherty et al. | |
| 2007/0084142 | A1 | 4/2007 | Matthews | |
| 2007/0151887 | A1 * | 7/2007 | Clark et al. | 206/494 |
| 2009/0039078 | A1 * | 2/2009 | Sanfilippo et al. | 220/4.27 |
| 2009/0120828 | A1 * | 5/2009 | Sanfilippo et al. | 206/508 |
| 2009/0273179 | A1 | 11/2009 | Scott et al. | |
| 2010/0113240 | A1 * | 5/2010 | Takita et al. | 493/210 |
| 2011/0058755 | A1 | 3/2011 | Guibert | |

FOREIGN PATENT DOCUMENTS

| | | | |
|---|---|---|---|
| FR | 2766794 | | 2/1999 |
| IT | 1274100 | B | 7/1997 |
| JP | 10-203560 | | 8/1998 |
| JP | 2005320032 | A | 11/2005 |
| WO | WO 02085726 | A1 * | 10/2002 |
| WO | WO-2004/024588 | | 3/2004 |
| WO | WO-2004/110885 | | 12/2004 |
| WO | WO 2004110885 | A1 * | 12/2004 |
| WO | WO-2006/091821 | A2 | 8/2006 |
| WO | WO-2007/058689 | | 5/2007 |

OTHER PUBLICATIONS

International Search Report and Written Opinion for corresponding International Application No. PCT/US2008/082689, dated Mar. 24, 2009.

International Search Report and Written Opinion for counterpart International Application No. PCT/US08/072554, dated Feb. 23, 2009.

Photographs of flexible container packaging, "Minibrick Pack", from Sonoco (Hartsville, South Carolina, USA) (became aware of in Dec. 2007).

*SBS Special Top Design Machine*, product sheet from Rovema Packaging Machines L.P. (Lawrenceville, Georgia, USA) (1 pg.) (2005).

Extended European Search Report, European application No. EP 09825498.0, dated Nov. 22, 2012.

Brody et al., *Encyclopedia of Packaging Technology*, 2nd ed., New York, NY: John Wiley & Sons (1993).

* cited by examiner

FLEXIBLE, STACKABLE CONTAINER USED FOR STORING A QUANTITY OF PRODUCT AND METHOD FOR MANUFACTURING SAME

CROSS-REFERENCE TO RELATED APPLICATIONS

This application claims priority to U.S. Provisional Patent Application No. 61/111,874, filed Nov. 6, 2008, and U.S. Provisional Patent Application 61/111,896, filed Nov. 6, 2008, the disclosures of which are hereby expressly incorporated by reference herein in their entireties. This application is related to U.S. Provisional Patent Application No. 60/987,031, filed on Nov. 9, 2007, entitled "Flexible, Stackable Container and Method and System for Manufacturing Same," U.S. Provisional Patent Application No. 60/989,635, filed on Nov. 21, 2007, entitled "Flexible, Stackable Container and Method and System for Manufacturing Same," U.S. Provisional Patent Application No. 61/016,802, filed on Dec. 26, 2007, entitled "Flexible, Stackable Container and Method and System for Manufacturing Same," and U.S. patent application Ser. No. 12/188,328, filed on Aug. 8, 2008, entitled "Flexible, Stackable Container and Method and System for Manufacturing Same," all of which are hereby expressly incorporated by reference herein in their entirety.

TECHNICAL FIELD

The present disclosure is directed to a flexible, stackable container for transporting and storing food items, liquids, powders, chemicals, detergent, dry goods pharmaceuticals, nutraceuticals and other packaged products, for example, and to methods and systems for manufacturing the same and, in particular to a flexible, stackable container having a sealed bag or package formed from a flexible film and recloseable fitment or lid attached thereto, or having a recloseable flap or other easy-opening feature without an additional fitment and/or lid.

BACKGROUND OF THE DISCLOSURE

Vertical form, fill, and seal (VFFS) packaging machines are commonly used in the snack food industry for forming, filling and sealing bags of nuts, chips, crackers and other products. Such packaging machines take a packaging film from a sheet roll and form the film into a vertical tube around a product delivery cylinder. One disadvantage of these packages is that the resulting filled package is not rigid enough to allow the stacking of one package on top of another in a display.

Another disadvantage to these packages is that they do not retain their shape after the package is opened, and a portion of the contents removed.

There are rigid packages and canisters that are stackable and do retain their shape after opening. However, these rigid packages that may overcome these disadvantages have their own disadvantages. One disadvantage is that the packages are often composed of composite material that is costly to produce. Another disadvantage is that rigid composite packages are often not recyclable. The ability to recycle a product container is increasingly becoming a demand from companies that produce and/or sell consumable products as well as a demand from consumers that are environmentally conscious. A demand also exists for containers that, if not recyclable, minimize the waste transported to a landfill. Once in the landfill, a demand also exists for materials that are degradable or biodegradable to further reduce the amount of material contained in the landfill.

Yet another disadvantage of many non-flexible and/or rigid containers is the shape of the container. Many product containers have cross sections that are round. In the market place where shelf space is at a premium, round containers require more shelf space than a square or rectangular container holding the same amount of product. Similarly, shipping round or other irregularly shaped containers requires more space than shipping square or rectangular containers that are more efficiently packed together in the transport containers. Moreover, round containers do not display graphics as well as containers having flatter sides. The graphics wrap around the curved surfaces of the containers, and the containers must be in order to fully view and read the graphical information. Inefficiency in shipping and displaying packaged products adds to the overall cost of the product. Additionally, inefficiency in packing round or irregularly shaped containers increases the number of shipping containers and vehicles, ships and planes required to transport the shipping containers. This adds to the cost of the product, but more importantly, results in the increased emission of environmentally damaging pollutants.

Another disadvantage to shipping many non-flexible containers is the weight of the container as compared to the weight of a flexible container manufactured to hold a like amount of product. Increased weight adds to shipping costs as well as adds to the amount of material that, if not recyclable, ends up in a landfill. Additionally, the material cost for the non-flexible containers is usually greater than the material cost for flexible containers.

It would, therefore, be desirable to provide a container that overcomes these and other disadvantages.

Figure 1:
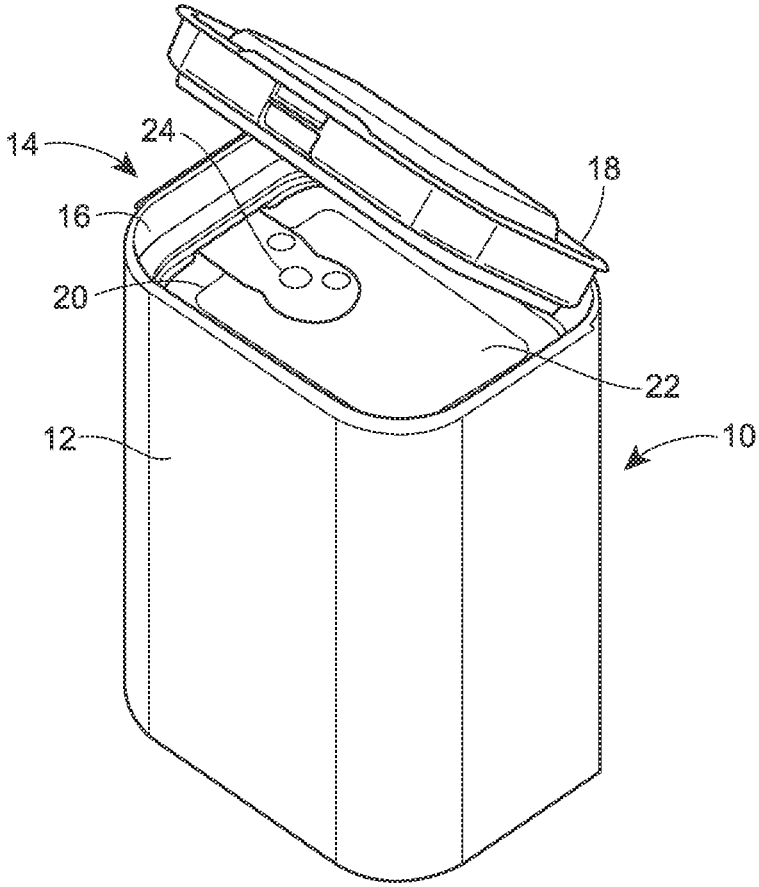
FIG. 1 is an isometric view of a flexible, stackable container in accordance with the present disclosure.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure and the claims.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 2:
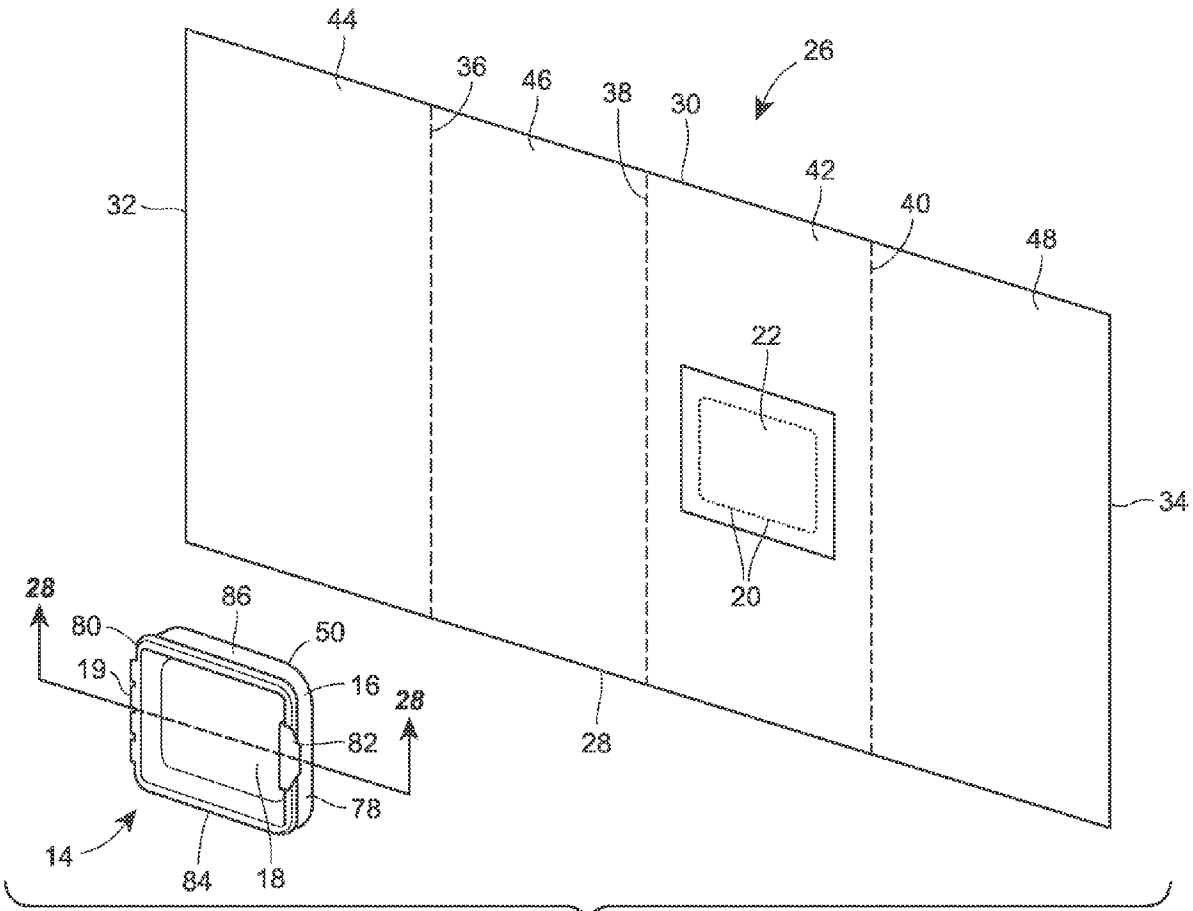
FIG. 2 is an isometric view of an unfolded sheet of film and a lid fitment of the flexible, stackable container of FIG. 1.

FIG. 1 illustrates an embodiment of a flexible, stackable container 10 in accordance with the present disclosure. The container 10 includes a flexible package 12 having a lid fitment 14 attached to one end to provide a recloseable/resealable access to the package 12 and to reinforce the package 12 to allow for stacking of the package 12 without collapsing. The package 12 as illustrated is the type of flexible packaging known to those skilled in the art as a quad seal package for the four corner seals formed in the corners of the bag. This feature will be described more fully below. The package 12 has a generally rectangular shape to conform to the shape of the lid fitment 14, but other shapes may be used. The lid fitment 14 is attached to a top side of the package 12 and is encircled by the corresponding corner seals. Depending on the particular configuration of the package 12 and lid fitment 14, and the requirements for the product packaged therein, the lid fitment 14 may be secured to the package 12 by seals formed between the lid fitment 14 and the corner seals, between the lid fitment and the surface of the side of the package 12 at which the lid fitment 14 is disposed, or a combination thereof. Alternative attachment configurations will be discussed more fully below. The lid fitment 14 includes a base 16 and a lid 18 pivotally connected by a living hinge 19 (FIG. 2). The base 16 and lid 18 have complimentary shapes so that a seal is formed therebetween when the lid 18 is closed down onto the base 16. In the illustrated embodiment, the top side of the package 12 disposed under the lid 18 has perforations 20 defining a flap 22 that may be punctured and removed by a consumer after purchase in order to access the interior of the package 12. To facilitate the removal of the flap 22, a pull tab 24 may be attached thereto in a manner that causes the perforations 20 to yield and the flap 22 to tear away when the pull tab 24 is pulled upwardly.

The package 12 may be formed from a sheet of film having a composition and structure that are appropriate for the product to be stored therein, and that may be designed to exhibit desired characteristics after disposal of the container 10. The sheet of film for the package 12 may be formed from materials such as polypropylene (PP), ethyl vinyl alcohol, polyethylene, EVA co-polymers, foil (such as aluminum foil), paper, polyester (PE), nylon (poly amide), and/or composites thereof. In other embodiments, the sheet of film may be formed from metalized oriented polypropylene (OPP) or metalized polyethylene terephthalate (PET). Still further, the sheet of film may include or be infused with a degradable or biodegradable component that may allow the container to degrade in a relatively short amount of time after the useful life of the container 10, such as after the container 10 is disposed in a landfill or other disposal facility. If necessary or desired based on the implementation, the film may include an outer ply of heat sealable oriented polypropylene or other material suitable for heat sealing so that the seals joining portions of the film as the container 10 is fabricated may be sealed and/or attached to the outer surface of the package 12 to form and shape the container 10.

The lid fitment 14 may be made from any appropriate material having the necessary properties to be sealed to the film of the package 12. For example, the lid fitment 14 may be made from a plastic material, such as PE, polyethylene terephthalate (PETE), polylactic acid (PLA), polyvinyl chloride (PVC), polystyrene (PS), PP, and the like, by means of an appropriate forming process, such as thermoforming, injection molding, casting or blow molding. As with the sheet of film, the fitment material may also include a degradable or biodegradable component to facilitate the breakdown of the container 10 after disposal. In alternative embodiments, the containers 10 may be constructed with lid fitments 14 having varying configurations, or without lid fitments. For example, the container 10 may include a fitment having the base 16 of the lid fitment 14, but omitting the lid 18 to leave the surface of the top side exposed. The perforations 20 may extend around a portion of the flap 22 so that the flap 22 may be opened but not completely detached from the package 12, and the pull tab 24 may cover and extend beyond the flap 22 and include a tacky substance that allows the pull tab 24 to reseal to the top surface of the package. Still further, the fitment may be eliminated completely in favor of the recloseable flap 22. Additional configurations are contemplated by the inventors as having use in containers 10 in accordance with the present disclosure.

The formation of the container 10 will now be described with reference to FIGS. 2-8. Referring to FIG. 2, a film sheet 26 from which the package 12 will be formed and the lid fitment 14 are shown separately. The container 10 may be formed by manually folding the film sheet 26 and attaching the lid fitment 14 thereto. However, when the containers 10 are mass produced, the film sheets 26 are formed on a continuous web of film that may be fed through a VFFS packaging machine. While the discussion herein relates to the formation of the containers 10 on VFFS machines, those skilled in the art will understand that the containers 10 may be formed by other types of machines or combinations of machines, such as horizontal form, fill and seal (HFFS) machines, Stand-Up Pouch type machines and the like, and the use of such machines or combinations of machines performing the various tasks in forming containers in accordance with the present disclosure is contemplated by the inventors. For consistency with the discussion below of the VFFS packaging machine 200 shown in FIG. 17, the elements of the film sheet 26 will be referenced with respect to their orientation as the film sheet 26 passes through the packaging machine 200. Consequently, the film sheet 26 has a lower leading edge 28, an upper trailing edge 30, and oppositely disposed lateral edges 32, 34. The dashed lines 36-40 in FIG. 2 indicate the separate top, bottom, rear and front sides 42-48 of the package 12 that will be defined as the film sheet 26 is folded and sealed to form the package 12. Prior to forming the package 12 from the film sheet 26, the perforations 20 are formed in a top side 42 by laser scoring, mechanical scoring or a similar process for forming perforations 42 in the film sheet 26 without puncturing the sheet 26, but allowing puncturing if necessary or desired based on the requirements for the container 10 and/or the stored product. Alternatively, blade scoring with approximately 60%-80% penetration, for example, may be used to form a score line defining the flap 22 instead of individual perforations 20. In other embodiments, full penetration through the top side 42 of the film sheet 26 may be performed by blade scoring to facilitate detachment of the flap 22. For example, a continuous blade score with full penetration through the sheet 26 may be performed with intermittent interruptions or bridges in the score line being provided to hold the flap 22 in place until a peel tab may be put in place or the consumer opens the container 10. The distance between the bridges may range from 0.1" to 2.0", and the length of the bridges may fall within the range of 0.002" to 0.090" depending on the implementation. Various alternative easy-opening features are discussed further below.

The lid fitment 14 is oriented with a bottom surface 50 facing the top side 42 to be formed in the film sheet 26. The lid fitment 14 has a front side 78 that may be oriented at the front of the container 10 and a rear side 80 opposite thereof. The living hinge 19 may rotatably connect the lid 18 to the base 16 at the rear side 80 of the lid fitment 14, and the front of the lid 18 may include a grip 82 to assist in opening the lid 18. Additional leverage tabs (not shown) may extend from the base 16 proximate the grip 82 to further facilitate opening of the lid 18 by allowing a user to press upwardly on the grip 82 and downwardly on the tab(s) to separate the lid 18 from the base 16. Lateral sides 84, 86 of the lid fitment 14 further assist in defining the shape of the container 10 as discussed more fully below. It should be noted at this point that relational terms such as top, bottom, front, rear and the like used in reference to the components and orientations of the container 10, package 12 and lid fitment 14 are used for consistency with the orientation of the container 10 as illustrated in FIG. 1 and clarity in describing the container 10. However, the container 10 may be implemented in other orientation as desired with the lid fitment 14 being disposed on any of the sides of the container 10 as may be dictated by the product stored therein, shipping or display requirements, marketing and/or advertising strategies and the like. In addition to reorientation of the container 10, it should also be noted that the lid fitment 14 may be attached to sides of the package 12 other than the top side 42, and the perforations 20 may define the flap 22 in sides other than the top side 42 as illustrated herein. Moreover, the side to which the lid fitment 14 is attached may, but is not required to, include corner seals as discussed herein for attachment of the lid fitment 14 to the package 12.

Figure 3:
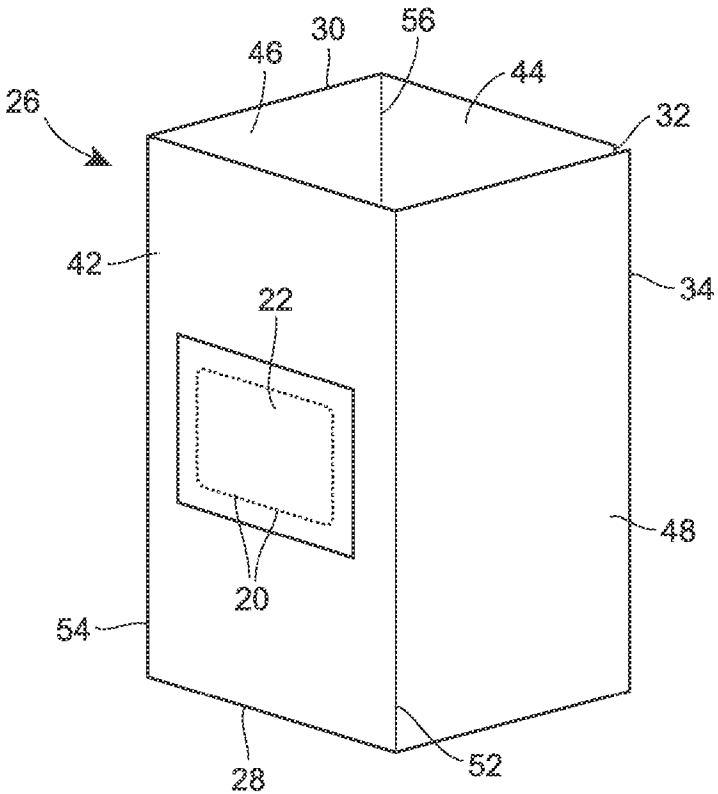
FIG. 3 is an isometric view of the sheet of film of FIG. 2 formed to define top, bottom and lateral sides.

The first step in forming the package 12 is illustrated in FIG. 3. The film sheet 26 is wrapped inwardly to form the desired shape based on the characteristics of the final package design. In the present example, the formed sheet 26 has a generally square or rectangular shape with corners 52-56 defining the top, bottom, rear and front sides 42-48. The lateral edges 32, 34 are disposed proximate each other and will ultimately have the corresponding portions of the sheet of film joined to form an edge seal at the fourth corner of the formed sheet 26, with the lateral edges 32, 34 and corresponding edge seal being disposed at the corner of the package 12. The seal at the corner may be any appropriate seal between the portions of the sheet of film proximate the lateral edges 32, 34, such as a fin seal wherein the inner surfaces of the film proximate the lateral edges are seal together, or a lap seal wherein the portions of the sheet of film are overlapped and sealed together. While the lateral edges 32, 34 are illustrated as meeting at one of the corners of the package 12, those skilled in the art will understand that the edges 32, 34 and the fin, lap or other appropriate seal may be disposed at any corner 52-56 or at any point along one of the sides 42-48 of the package 12 if desired.

Figure 4:
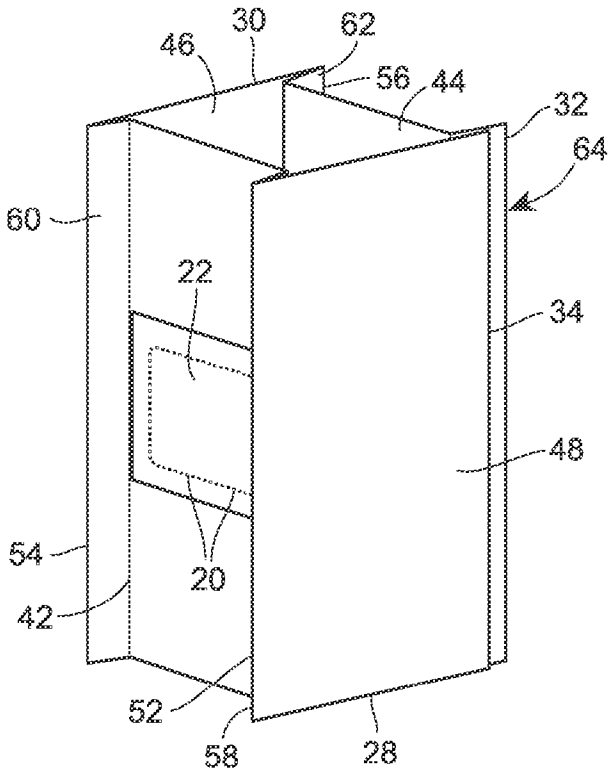
FIG. 4 is an isometric view of the sheet of film of FIG. 3 having corner seals formed at the corners.
Figure 5A:
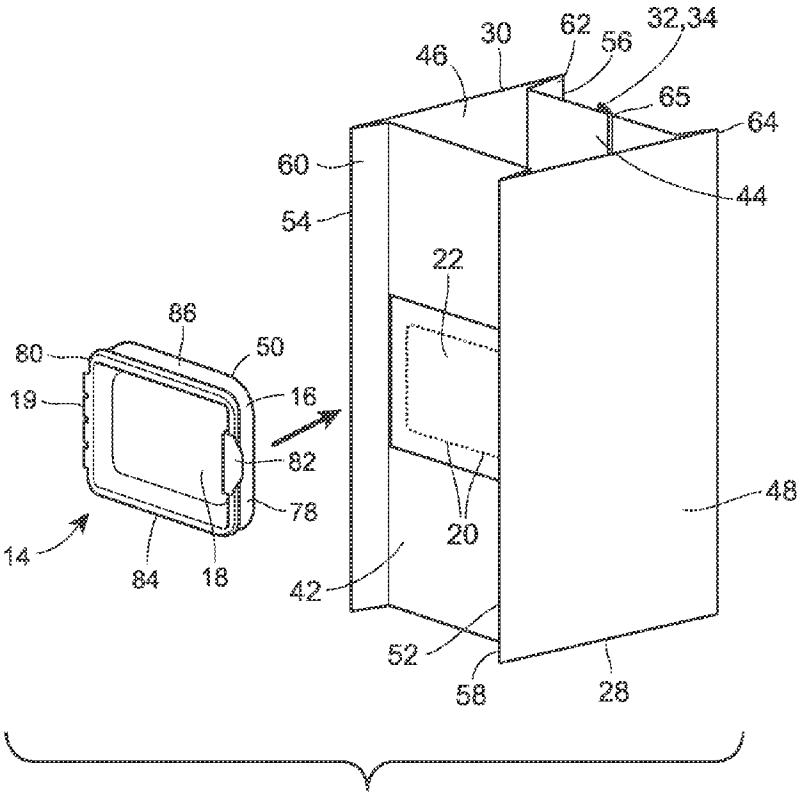
FIG. 5A is an isometric view of an alternative embodiment of the sheet of film of FIG. 4 and lid fitment of FIG. 2 with the lateral edges disposed and forming an edge seal on the bottom side of the package.
Figure 5:
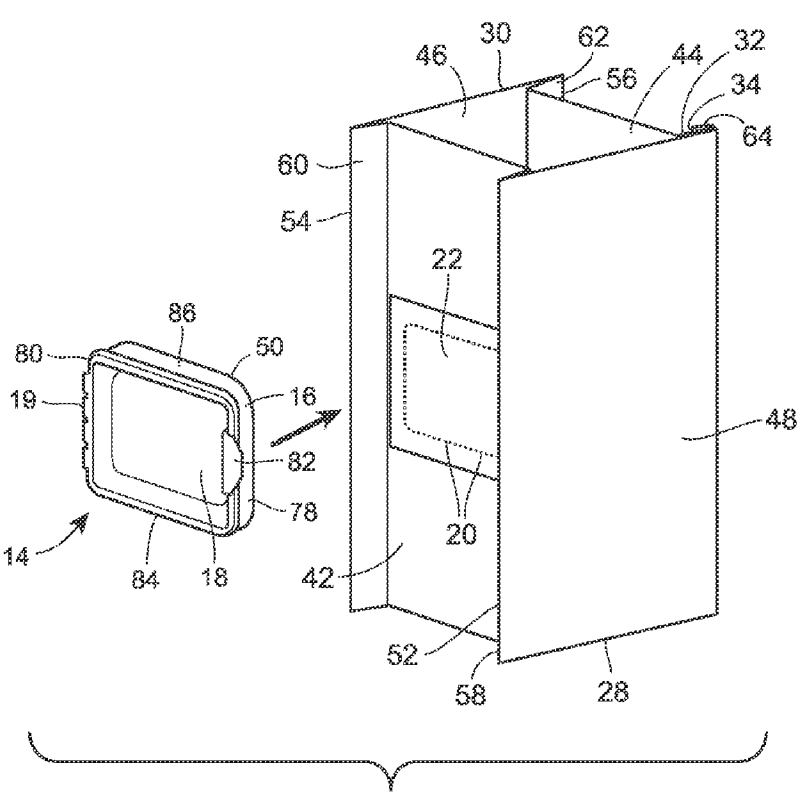
FIG. 5 is an isometric view of the sheet of film of FIG. 4 and lid fitment of FIG. 2 with the lateral edges of the sheet of film folded and sealed to form a combined edge seal and corner seal.

Turning to FIG. 4, after forming the film sheet into the desired shape, corner seals 58-64 are formed at the corners 52-56 and at the corner at which the lateral edges 32, 34 meet. Folds are made in the top and bottom sides 42, 44 of the film sheet 26 inwardly from both corners 52-56 to bring the folded portions into contact with the inner surfaces of the sides 46, 48. Once folded inwardly, the folded portions are welded, adhered or otherwise sealed to sides 46, 48. As a result, the four corner seals 58-64 extend outwardly substantially perpendicular to the top and bottom sides 42, 44 of the film sheet 26. The lateral edges 32, 34 may also be sealed together to form a combination edge seal and corner seal 64 as shown in FIG. 5. The inner surface of the folded portion of the bottom side 44 is brought into alignment and contact with the inner surface of the corresponding portion of the front side 48 proximate the lateral edge 34. The surfaces are then sealed together in a similar manner as the other corner seals 58-62. To further reinforce the combination edge seal and corner seal 64, a portion of the seal 64 may be folded inwardly and into contact with the unfolded portion of the combination seal 64. If necessary or desired, the folded and unfolded portions of the combination seal 64 may also be sealed for further reinforcement. With the corner seals 58-64 formed, the lid fitment 14 may be connected to the package 12 proximate the flap 22 on the top side 42. Those skilled in the art will understand that the forming steps illustrated in FIGS. 3-5 may occur separately or may be performed together by an appropriately configured packaging machine.

If desired or dictated by the requirements of the particular container 10, the film sheet 26 and the packaging machine 200 may be configured to form a package 12 having the edge seal disposed at a location other than at one of the corner seals. As shown in an alternative configuration of the package 12 in FIG. 5A, the lateral edges 32, 34 of the film sheet 26 may meet in the middle of the bottom side 44. Instead of being a combined edge and corner seal, the seal 64 is a corner seal formed in a similar manner as the other corner seals 58-62. At the point where the edges 32, 34 meet, an edge seal 65 is formed by bringing the portions of the film sheet 26 proximate the lateral edges 32, 34 together and forming a seal therebetween, such as a fin or lap seal, using heat sealing or other appropriate sealing method. Once sealed, the edge seal 65 in the form of a fin seal may be folded over and tacked to the outer surface of the bottom side 44 if desired.

Figure 6:
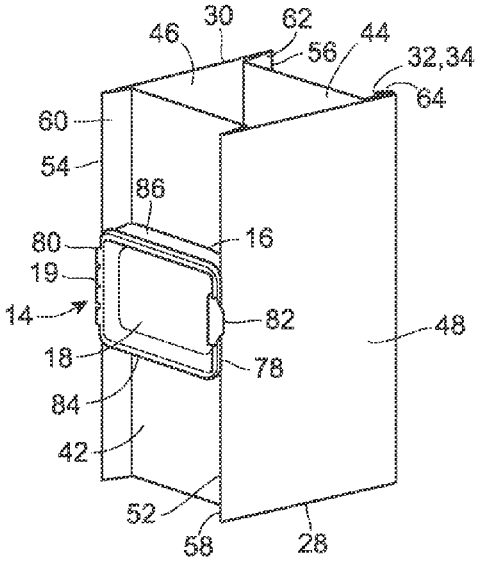
FIG. 6 is an isometric view of the sheet of film of FIG. 5 with the lid fitment attached to a top side thereof.

As shown in FIG. 6, the lid fitment 14 is disposed with the bottom surface 50 facing the outer surface of the top side 42 of the package 12. In this embodiment, the front and rear sides 78, 80 of the lid fitment 14 are disposed adjacent to the corner seals 58, 60 of the top side 42. In one embodiment, the corner seals 58, 60 are then sealed to the sides 78, 80 of the base 16 of the lid fitment 14. For example, the corner seals 58, 60 may be heat sealed to the sides 78, 80 of the lid fitment 14, or may be attached using time or pressure seals, adhesive seals, welding or any other appropriate fastening mechanism. In alternative embodiments, the bottom surface 50 of the base 16 of the lid fitment 14 may be sealed to the outer surface of the top side 42 of the package 12 using one of the sealing mechanisms discussed above or another appropriate mechanism. Still further, the lid fitment 14 may be attached with seals formed with both the corner seals 58, 60 and the outer surface of the top side 42.

Figure 7:
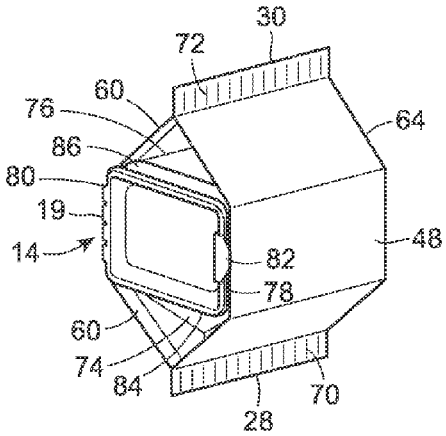
FIG. 7 is an isometric view of the sheet of film and lid fitment of FIG. 6 with the leading and trailing edges sealed to form leading and trailing seals.

Once the lid fitment 14 is attached, the open ends of the package 12 may be sealed to close the package 12, and folded and tacked down to conform the shape of the package 12 to the lid fitment 14. Referring to FIG. 7, the lateral side portions of the leading and trailing edges 28, 30 are brought toward each other and sealed together to form leading and trailing seals 70, 72. In order to ensure the leading and trailing seals 70, 72 of the package 12 wrap around the outer surface of the package 12 and the lid fitment 14 neatly to form a relatively smooth and uniform outer surface for the container 10, it may be necessary to tuck the film between the corner seals 58-64 on the top and/or bottom sides 42, 44 of the package 12 at the time the leading and trailing seals 70, 72 are formed. To accomplish this, when the leading and trailing edges 70, 72 of the package 12 are brought together, the corresponding portions of the top and bottom sides 42, 44 may be moved inwardly to tuck the sides 42, 44 as the edges 28, 30 move together and are sealed to form the leading and trailing seals 70, 72 of the package 12. As the leading and trailing seals 70, 72 are being formed, the package 12 may be filled with a quantity of the product for which the container 10 is designed. Consequently, the leading seal 70 may be formed first, the product deposited in the package 12, and then the trailing seal 72 may be formed, or the trailing seal 72 may be formed first if necessary to facilitate the manufacturing of the container 10.

Figure 8:
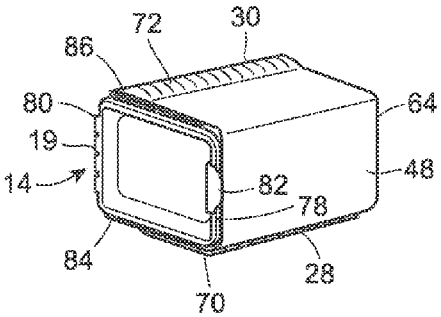
FIG. 8 is an isometric view of the sheet of film and lid fitment of FIG. 7 with the leading and trailing seals folded over and tacked to the outer surfaces of the package.

Having formed the leading and trailing seals 70, 72, the seals 70, 72 and the corresponding loose portions of the film proximate thereto may be folded over and attached to the outer surface of the package 12 to complete the formation of the container 10 as shown in FIG. 8. The seals 70, 72 may be wrapped around the lid fitment 14 to conform the loose portion to the outer surfaces of the lid fitment 14 and the package 12, and the seals 70, 72 may be attached to the outer surface of the package 12. The seals 70, 72 may be attached to the surface of the package 12 using heat, time or pressure sealing techniques, or by applying a hot tack adhesive between the seal 70, 72 and the outer surface, or other welding processes. The loose portion of the film should lay relatively flat and conform to the stationary portion of the package 12 when folded and sealed due to the tucks 74, 76 made in the sides 42, 44 at the time the leading and trailing seals 70, 72 were formed. Once the seals 70, 72 are folded and tacked, the portions of the corner seals 58, 60 proximate the lateral sides 84, 86 of the lid fitment 14 may be sealed thereto in a similar manner as to the front and rear sides 78, 80.

The steps performed in the process described in FIGS. 2-8 and the orders in which they are formed are exemplary. Those skilled in the art will understand that the process may be varied to form the container 10, and the configuration of the container 10 may also be varied, and such variations are contemplated by the inventors. For example, the lid fitment 14 may be attached to film sheet 26 prior to folding the sheet 26 to form the sides 42-48. Alternatively, the package 12 may be fully formed as shown in FIG. 8 before the lid fitment 14 is sealed thereto. Even where the lid fitment 14 is attached to the top side 42 as shown in FIG. 6, the lid fitment 14 may be merely tacked in place at that time to assist in properly shaping the package 12, with the seals between the base 16 of the lid fitment 14 and the corner seals 58, 60 and/or the top surface of the top side 42 being made after the package 12 is fully formed. Still further, in a manner illustrated more fully below, the package 12 may be formed with the leading edge 28 sealed and the trailing edge 30 open, and with the lid fitment 14 being attached before or after the product is dispensed into the package 12. Of course, the container 10 may be formed with the lid fitment 14 attached to any of the sides of the package, as well as without including a lid fitment 14 as discussed above. The steps may also be varied to allow the product to be deposited in the package 12 at an appropriate point in the process. As an example, it may be advantageous to form the leading seal 70, and fold over and tack the seal 70 to the surface of the package 12 before depositing the product in the package 12 so that the product does not interfere with folding over the seal 70. Once the product is deposited, the trailing seal 72 may then be formed, folded over and tacked to the surface of the package 12.

The configuration of the container 10 may also be varied as desired while still forming a sealed package 12 from a sheet of film 26 and sealing a lid fitment 14 thereto in a manner that allows the container 10 to be reclosed after the package 12 is opened. For example, the package 12 may be formed with only the corner seals 58, 60 that surround the top side 42 of the package, and without the corner seals 62, 64 at the bottom side 44, thereby allowing the container 10 to rest on the outer surface of the bottom side 44 when stored on a shelf or when stacked on top of another container 10. In such embodiments, the corner seals 62, 64 of FIGS. 5 and 5A may be omitted, and the edge seal 65 may be formed at one of the corners of the bottom surface 44, or at a point along the bottom surface 44. With the omission of the corner seals 62, 64, the edge seal 65 may still be formed before the leading seal 70 and trailing seal 72 are formed, or the seals 70, 72 may be formed prior to forming the edge seal 65 in the bottom surface 44. In some implementations, an additional sheet of film, paper label, fitment structure or the like may be attached to the bottom side 44 having corner seals 62, 64 or to the flat bottom side 44 to ensure the integrity of the sealing and attachment of the portions of the film sheet 26 on the bottom side 44, to facilitate the stacking of the container 10 on a shelf or on other containers 10 and/or to provide additional usable printable space on the exterior of the container 10 for bar codes and other relevant product information. The corner seals 58, 60 may be formed with an orientation other than perpendicular to the top side 42 of the package 12, and the base 16 of the lid fitment 14 may have a complimentary shape to the orientation of the corner seals 58, 60 so that the corner seals 58, 60 may be sealed thereto. Alternatively, the corner seals 58, 60 may also be omitted, and the bottom surface 50 of the base 16 may the sealed directly to outer surface of the top side 42. Where the corner seals 58, 60 are not formed to surround the top side 42, the base 16 may be configured to slip over the edges of the top side 44 and have an inner surface sealed to the outer surfaces of the front, rear and lateral sides of the package 12 proximate the top side 42. Still further, the package 12 may be formed into other shapes than the generally cubic shapes illustrated herein, and may have more or fewer than the six sides. For example, the container may have a substantially cylindrical shape such that the top and bottom sides are circular or ovoid, with the lid fitment 14 having a complimentary shape to facilitate formation of the seal(s) between the package 12 and the lid fitment 14. Other package 12 and lid fitment 14 geometries that may be used in containers 10 an accordance with the present disclosure will be apparent to those skilled in the art and are contemplated by the inventors.

Figure 9:
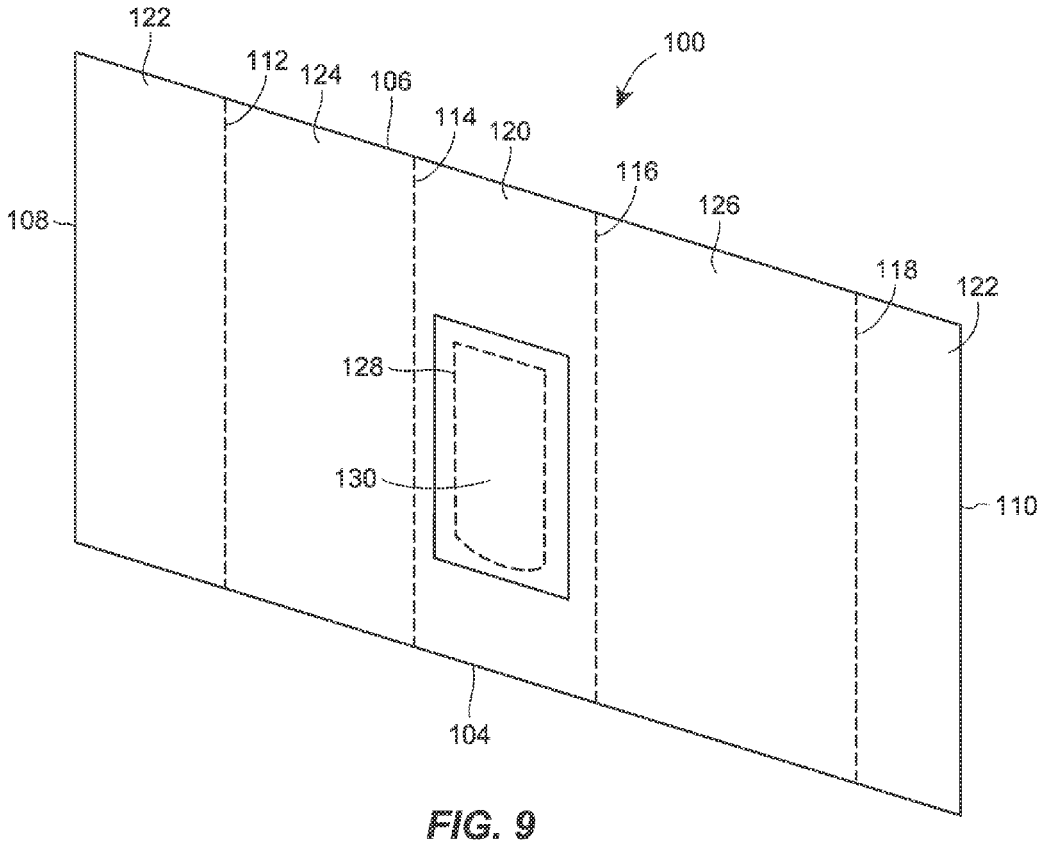
FIG. 9 is an isometric view of an unfolded sheet of film and a lid fitment of an alternative embodiment of a flexible, stackable container.

The alternative configurations of the container 10 may be formed using alternative sequences of folding, sealing and tacking/attachment steps to form a sealed package from a sheet of film and sealing a lid fitment thereto. One example of an alternative sequence is described with reference to FIGS. 9-16. Referring to FIG. 9, a film sheet 100 from which a package 102 of a container in accordance with the present disclosure will be formed is shown. The package 102 may be configured to have the lid fitment 14 or an alternative embodiment of a lid fitment attached thereto. As with the container 10, the container may be formed manually or by appropriately configured packaging equipment. For clarity and consistency with the previous discussion, the elements of the film sheet 100 will be referenced with respect to their orientation as a web of film passes through a packaging machine. Consequently, the film sheet 100 has a lower leading edge 104, an upper trailing edge 106, and oppositely disposed lateral edges 108, 110. The dashed lines 112-118 in FIG. 9 indicate the separate top, bottom, rear and front sides 120-126 of the package 102 that will be defined as the film sheet 100 is folded and sealed to form the package 102. As will be discussed further, the top side 120 of the package 102 is approximately centered on the film sheet 100 between the lateral edges 108, 110, and the bottom side 122 will be formed from the outer portions of the film sheet 100 proximate the lateral edges 108, 110. Perforations 128 or other weakening means are formed in the top side 120 to form a score line defining a flap 130.

Figure 10:
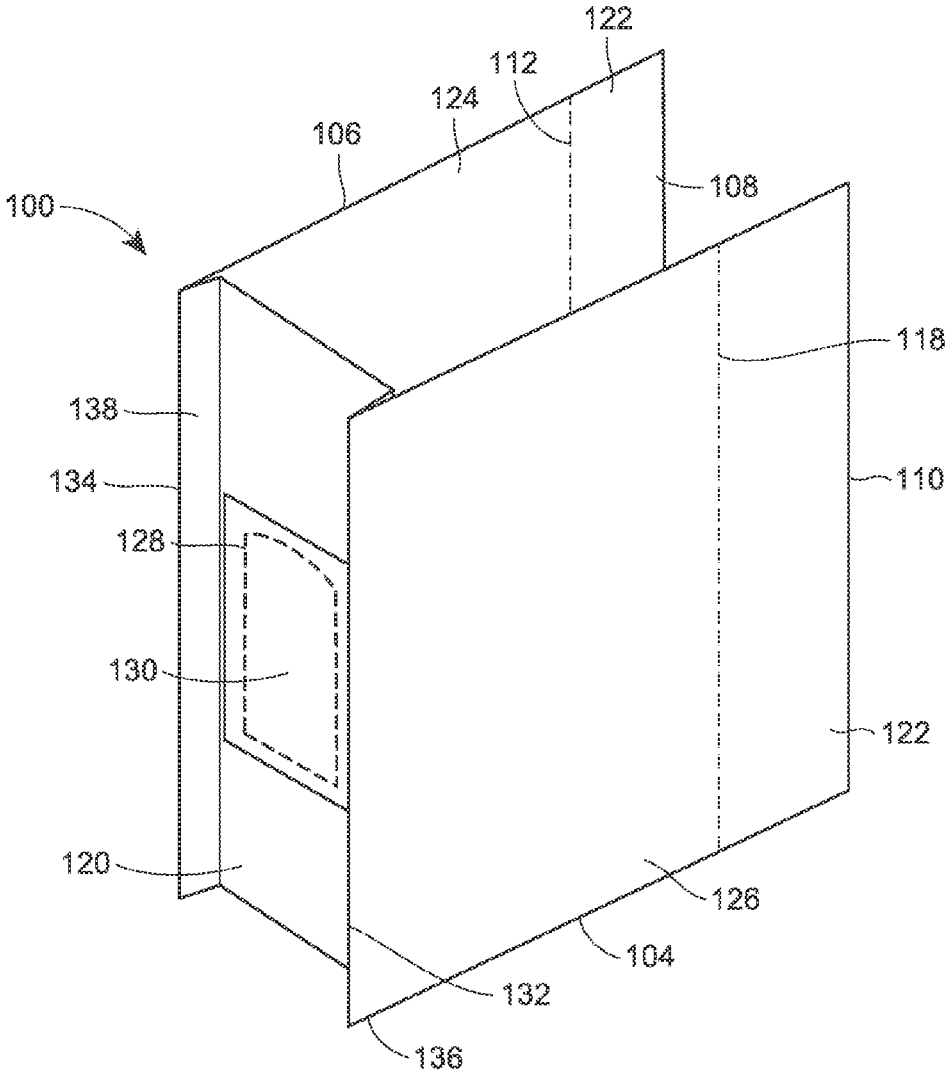
FIG. 10 is an isometric view of the sheet of film of FIG. 9 formed to define a top side having corner seals formed at the corners.
Figure 11:
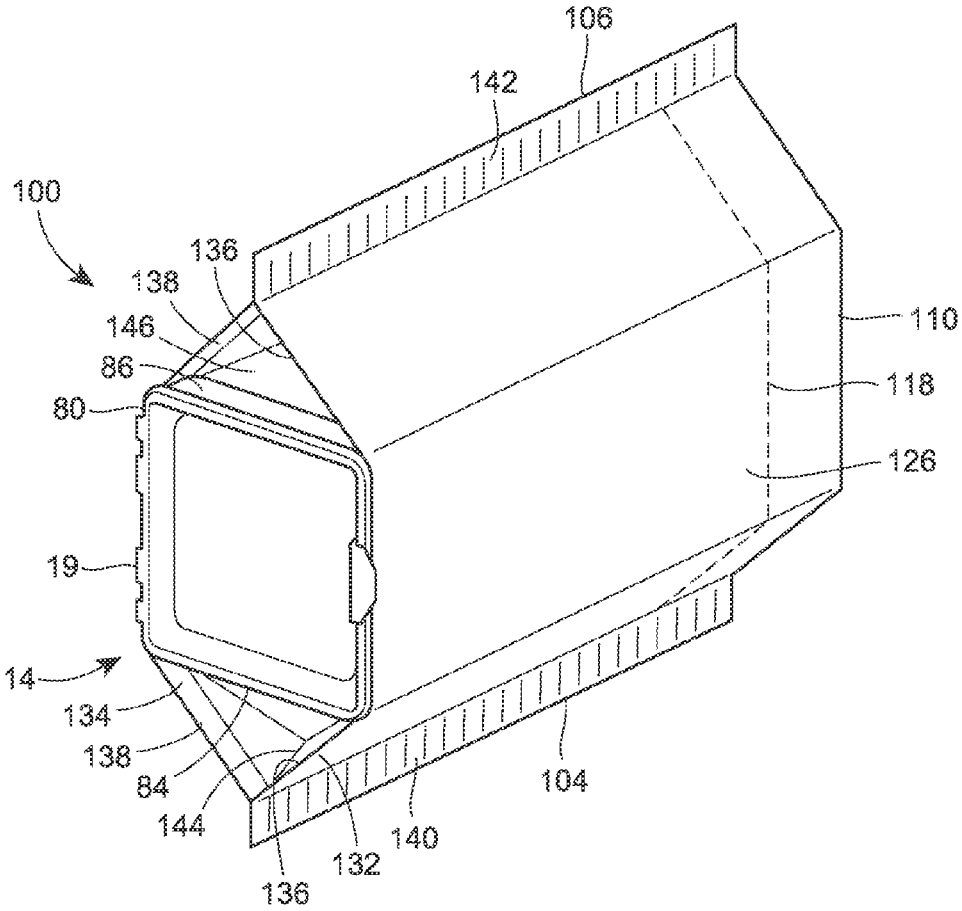
FIG. 11 is an isometric view of the sheet of film of FIG. 9 with a lid fitment attached to a top side thereof and with the leading and trailing edges sealed to form leading and trailing seals.
Figure 12:
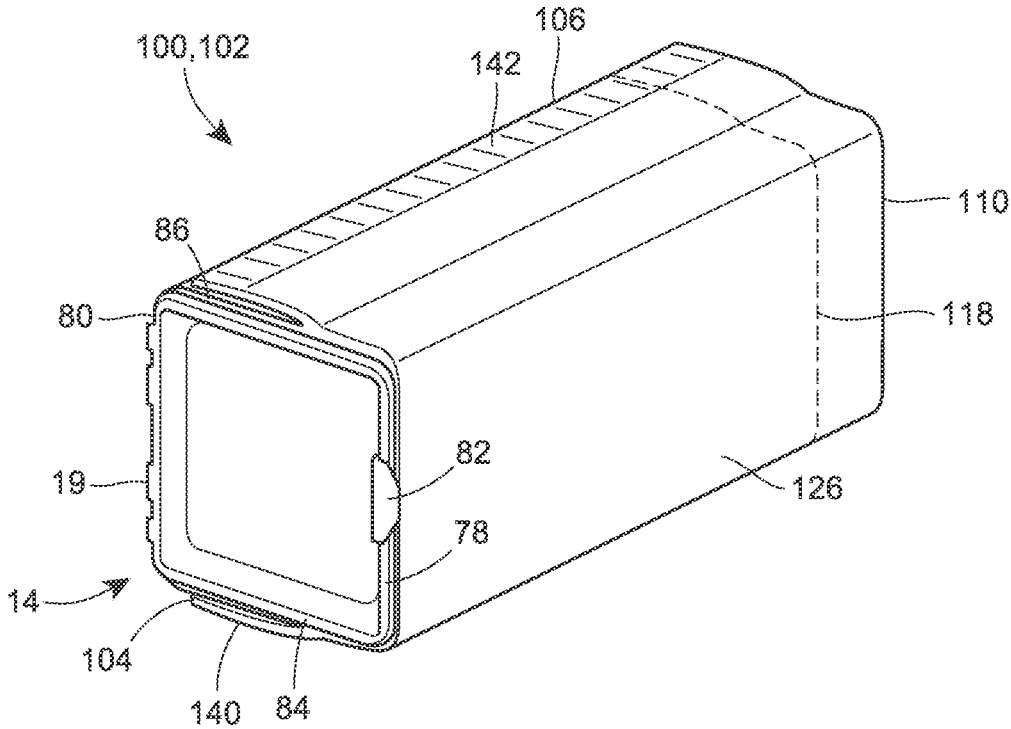
FIG. 12 is an isometric view of the sheet of film and lid fitment of FIG. 11 with the leading and trailing seals folded over and tacked to the outer surfaces of the package.

Referring to FIG. 10, the film sheet 100 is folded or wrapped inwardly at the dashed lines 114, 116 to form corners 132, 134 between the top side 120 and the front and rear sides 126, 124, respectively, with dashed lines 112, 118 remaining unfolded. The top side 120 is also folded inwardly from the corners 132, 134 and sealed to form corner seals 136, 138 in a similar manner as the corner seals 58, 60 of the package 12. After the corner seals 136, 138 are formed, the lid fitment 14 may be attached to the top side 120 and the leading and trailing edges 104, 106 may be sealed as shown in FIG. 11.

The lid fitment 14 may be disposed with the bottom surface 50 facing the outer surface of the top side 12, and with the front and rear sides 78, 80 of the lid fitment 14 being disposed adjacent to the corner seals 136, 138. Before or after the lid fitment 14 is attached, the oppositely disposed lateral side portions of the leading and trailing edges 104, 106 at the rear and front sides 124, 126 are brought toward each other and sealed together to form leading and trailing seals 140, 142. If necessary, tucks 144, 146 in film sheet 100 between the corner seals 136, 138 on the top side 122 are made at the time the leading and trailing seals 140, 142 are formed in a manner as described above. Having formed the leading and trailing seals 140, 142, the seals 140, 142 and the corresponding loose portions of the film sheet 100 proximate thereto may be folded over and attached to the outer surface of the package 102 to complete the formation of the lateral sides of the package 102. Once the seals 140, 142 are folded and tacked, the corner seals 136, 138 may be sealed to the lid fitment 14 in a similar manner as discussed above.

Figure 13:
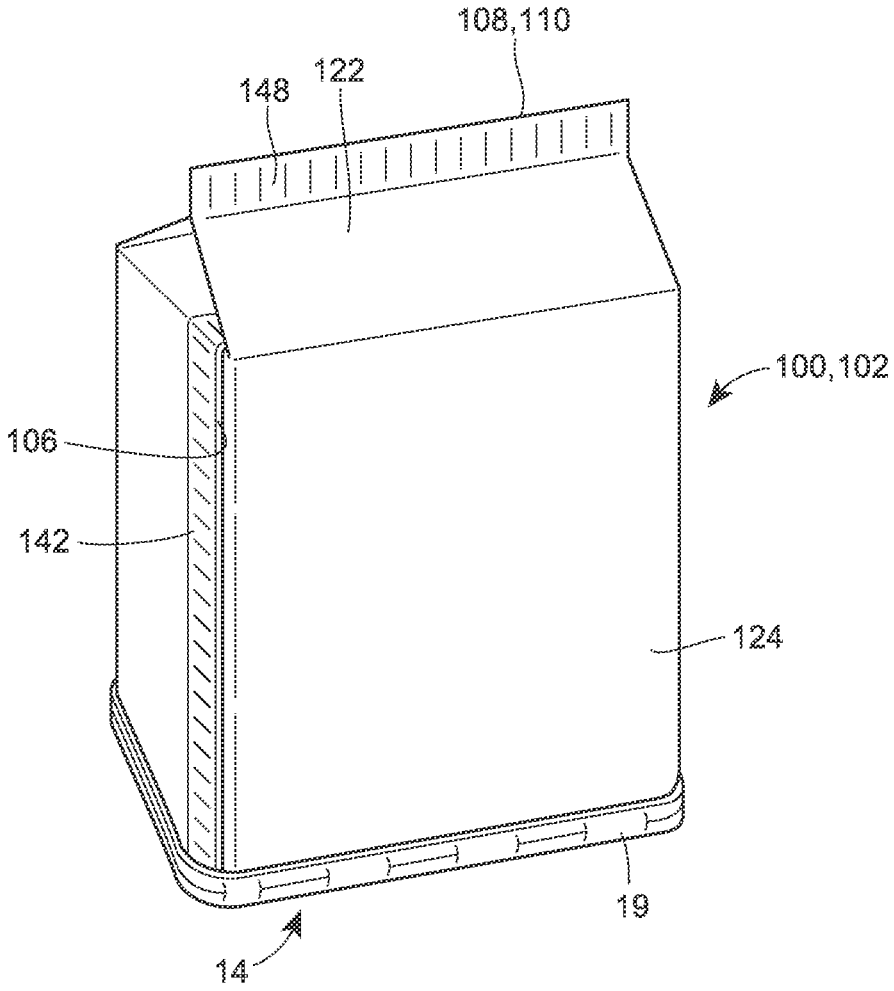
FIG. 13 is an isometric view of the sheet of film and lid fitment of FIG. 12 with the lateral edges sealed to form an end seal of the package.
Figure 14:
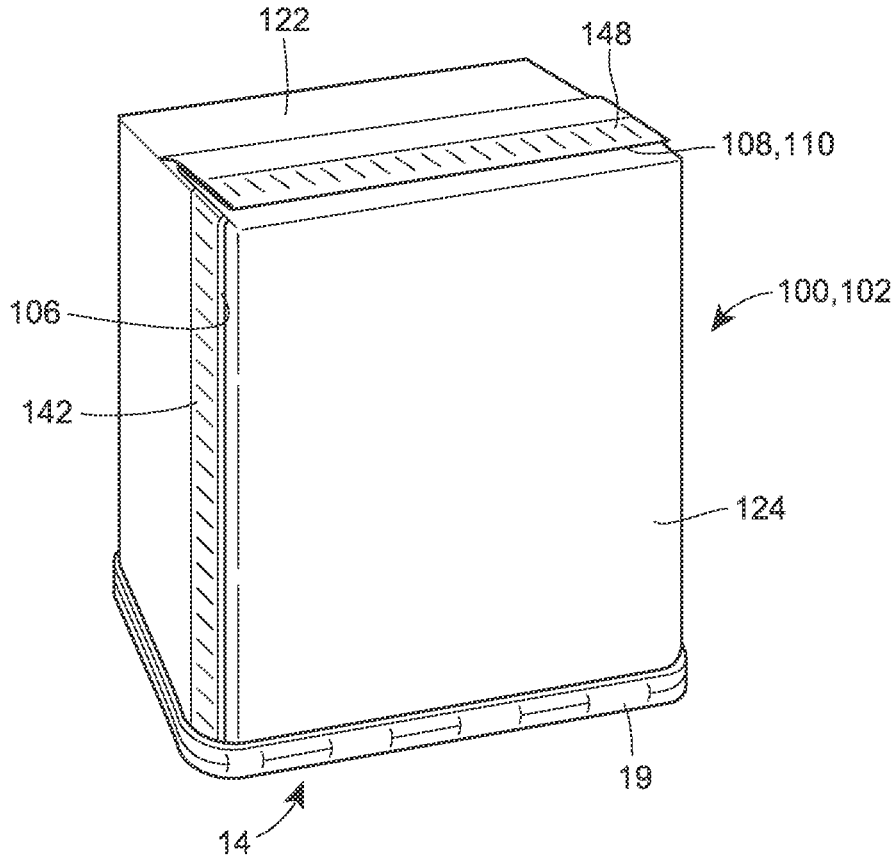
FIG. 14 is an isometric view of the sheet of film and lid fitment of FIG. 13 with the end seal folded over and tacked to the outer surface of the package.

Once the lid fitment 14 is attached and sealed to the top side 120, the package 102 may be filled with the product, and the bottom side 122 may be sealed and folded flat to facilitate stacking of the containers in cartons and on display shelves. The film sheet 100 may be folded and attached to form the flat bottom side 122 using conventional folding techniques. In one example shown in FIGS. 13 and 14, the lateral edges 108, 110 may be sealed together and folded in a similar manner as the leading and trailing edges 106, 108 as discussed above. Referring to FIG. 13, the portions of the lateral edges 108, 110 at the rear and front sides 124, 126 may be brought together and sealed as the portions at the lateral sides of the package 102 are tucked inwardly to form an end seal 148. After forming the end seal 148, the end seal 148 and the loose portions of the film sheet 100 proximate thereto may be folded over and attached to the outer surface of the package 102 to complete the formation of the bottom side 122.

Figure 15:
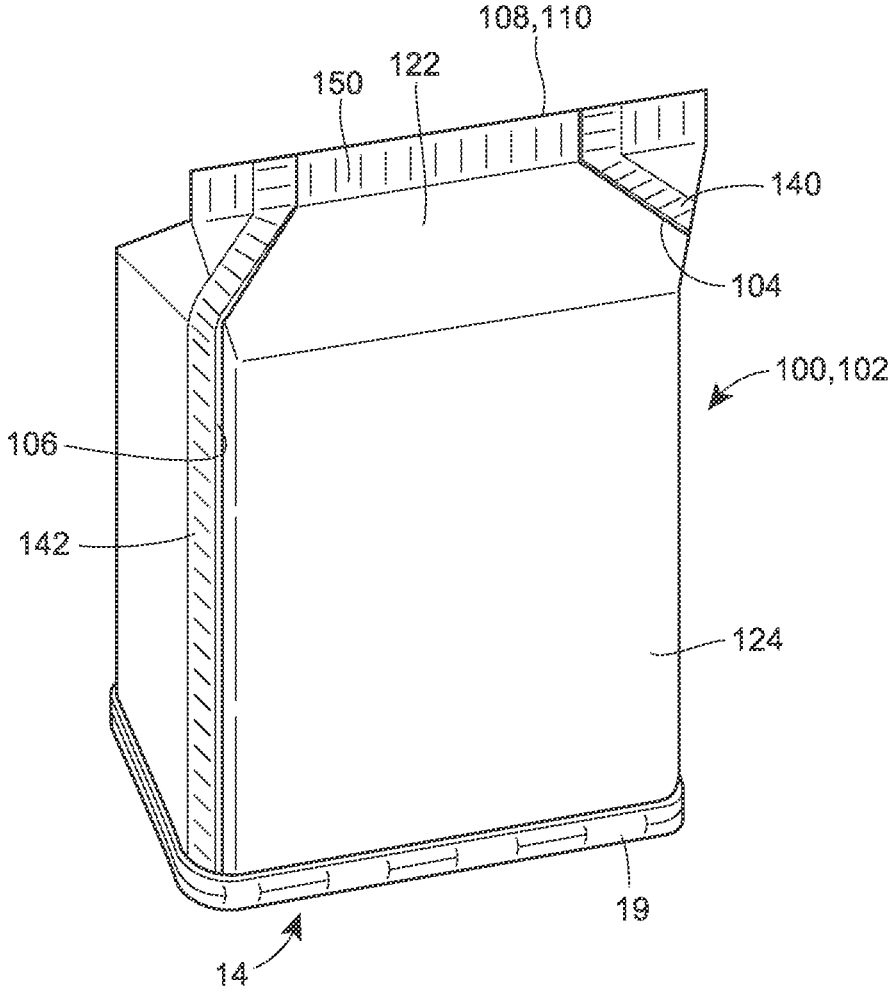
FIG. 15 is an isometric view of the sheet of film and lid fitment of FIG. 12 with the lateral edges sealed to form an alternative end seal of the package.
Figure 16:
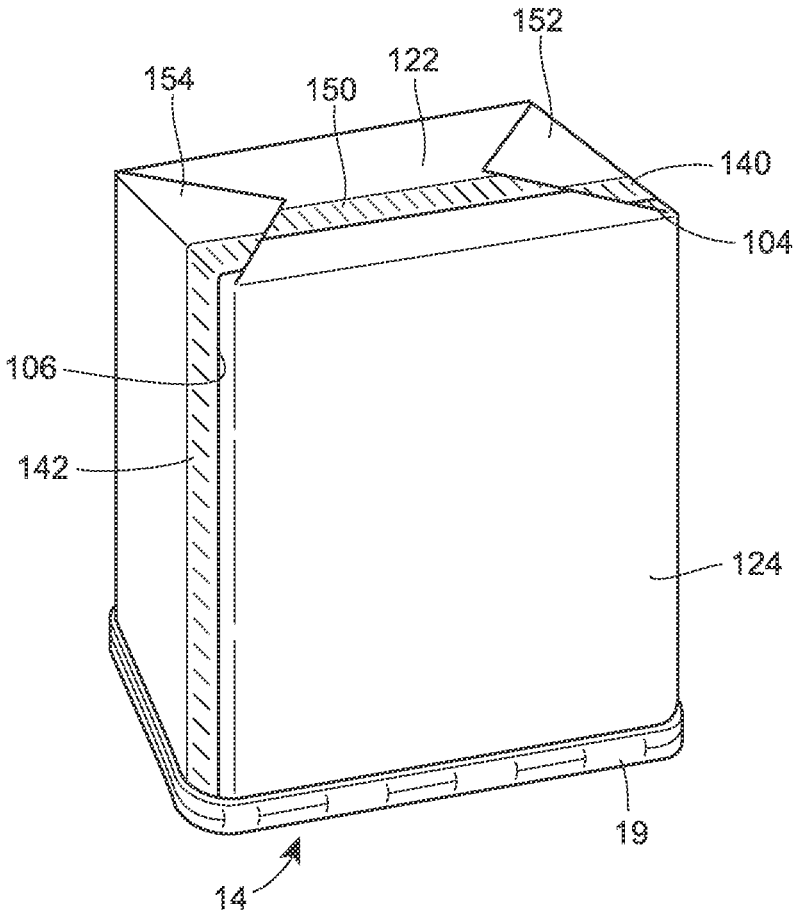
FIG. 16 is an isometric view of the sheet of film and lid fitment of FIG. 15 with the end seal folded over and tacked to the outer surface of the package.

FIGS. 15 and 16 illustrate a further example of a flat bottom side 122. As shown in FIG. 15, instead of tucking the portions of the lateral edges 108, 110 at the lateral sides of the package 102 inwardly, the portions are pulled outwardly and taughtly to bring the lateral edges 108, 110 together and sealed to form an end seal 150. Once formed, the central portion of the end seal 150 and the loose portions of the film sheet 100 proximate thereto may be folded over as shown in FIG. 16 and attached to the outer surface of the package 102. Because the lateral edges 108, 110 were pulled outwardly, oppositely disposed lateral flaps 152, 154 remain unattached at the lateral ends of the bottom side 122 and end seal 150. To complete the formation of the bottom side 122, the lateral flaps 152, 154 are folded inwardly over the central portion of the end seal 150 and attached to the surface of the film 100. As discussed, the illustrated methods for forming the bottom side 122 are exemplary, and those skilled in the art will understand that additional alternative folding methods may be used to form the flat bottom side 122. For example, additional flat bottom bag styles are known and produced by the SBS Brick Pack Machine manufactured and sold by Rovema Packaging Machines, L. P., and are shown at http://www.rovema.com/sbs.asp, the disclosure of which is incorporated by reference herein. These and similar side forming methods are contemplated by the inventors as having use in containers in accordance with the present disclosure.

The type of seals formed at the seals 58-64, 70, 72, 136-142, 148, 150 and between the sides 78, 80, 84, 86 of the lid fitment 14 and the top sides 42, 122 and/or corner seals 58, 60, 136, 138 may be dictated by the product to be stored within the container. The seals formed for the container may be only those necessary to retain the product within the container both when the package is sealed and when the top surface of the package is punctured and the lid 18 is closed down onto the base 16 of the lid fitment 14 to reclose the container. For example, it may not be necessary to incur the expense of forming air and water tight seals where the container will store non-perishable or non-spoilable products, such as BBs and the like. These types of products may also allow for greater fault tolerance for gaps, channels, wrinkles and other imperfections or "channel leakers" that are unintentionally formed in the seals but do not allow the stored produce to leak from the container. Of course, non-perishable items having smaller granules, such as powdered detergents, may require more impervious types of seals, as well as greater reliability and fewer imperfections in the sealing processes. Liquids may similarly require liquid-impervious seals that are reliably formed in the container.

For food items such as potato chips and cereal, or other types of products where freshness and crispness of the product should be maintained prior to and after the package is opened, hermetic seals may be formed to protect from or prevent the passage of air and/or moisture through the seals. Other food items may require packaging that can breathe for proper storage. For example, lettuce and other produce may continue to respire while in the container to convert carbon dioxide into oxygen, and consequently require a certain level of venting of the air within the package to maintain a desired atmosphere in the container. Alternatively, a specific film structure having the desired venting properties or some other form of appropriate package venting may be used instead of relying on the seals to provide the necessary ventilation. As another example, coffee beans may continue to release gases after roasting, thereby increasing the pressure within the package, and consequently necessitating air flow through the seals and/or the film so that excessive pressure does not build up within the package after the package is sealed. Still other products may require certain levels of water vapor transmission rates to adequately store the product in the container for the expected storage duration. Those skilled in the art will understand that the particular seals formed in the container as well as the properties of the sheet of film from which the package is manufactured in a particular implementation may be configured as necessary to meet the varying needs of the stored products, if any, for air and water transmission between the interior of container and the external environment. Consequently, seals as used herein in the descriptions of the various embodiments of the containers is not intended to be limiting on the type of seal being formed except where noted.

Figure 17:
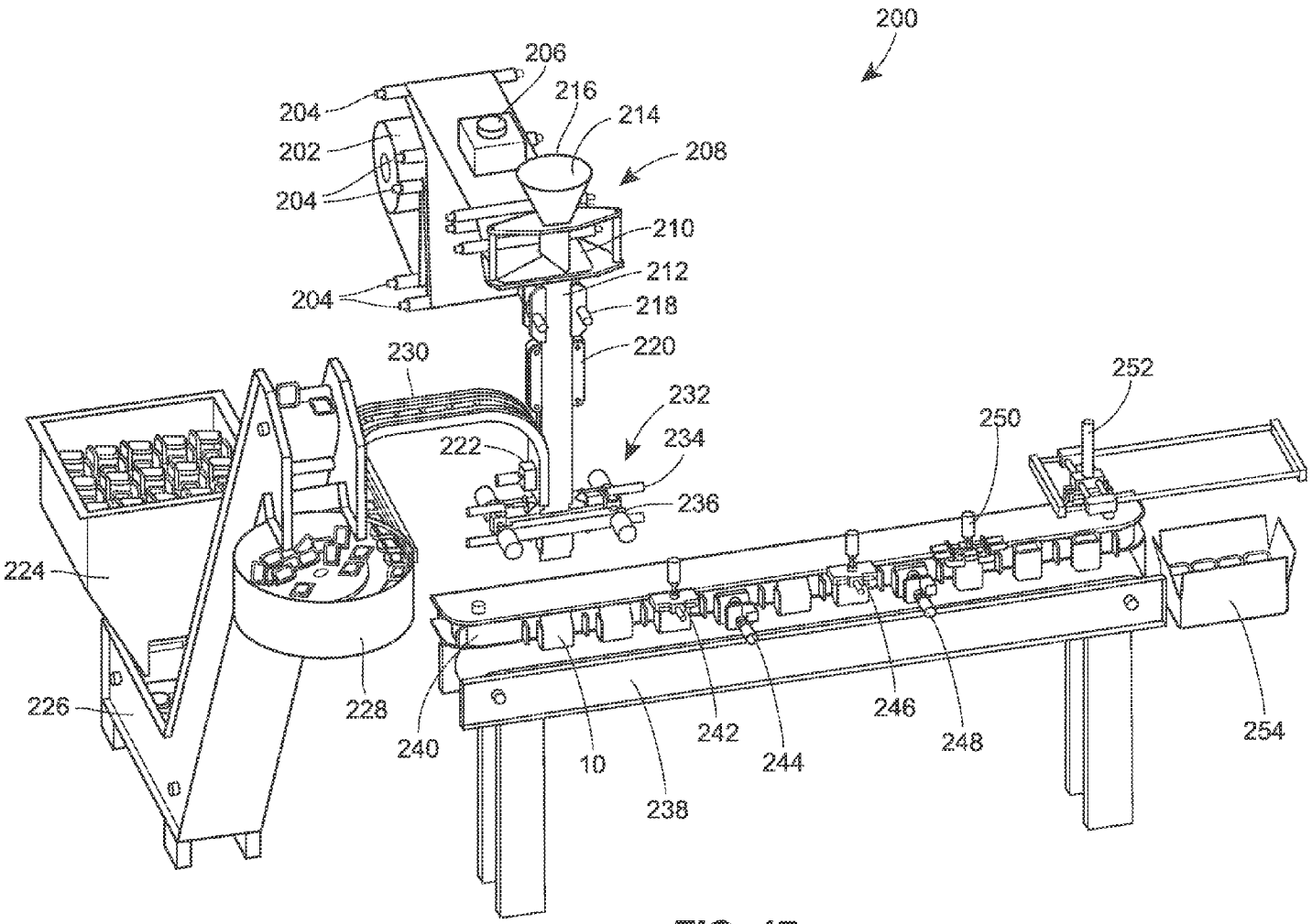
FIG. 17 is a schematic illustration of a packaging machine configured to produce the flexible, stackable container of FIG. 1.

FIG. 17 schematically illustrates one example of a packaging machine 200 configured to produce flexible stackable containers 10 of FIGS. 1-8 in accordance with the present disclosure. For example, the machine 200 may produce the container 10 discussed previously. The machine 200 may be of the type known to those skilled in the art as a vertical form, fill and seal (VFFS) packaging machine. The packaging machine 200 is capable of continuously forming a series of containers 10 from a web of film that may be fed into the packaging machine 200. In most applications, the web is pre-printed with graphics relating to the product to be disposed within the container, such as product information, manufacturer information, nutritional information, bar coding and the like. The web of packaging film is provided on a film roll 202 rotatably mounted on a shaft at the inlet end of the packaging machine 200. The packaging film is typically fed into the packaging machine 200 over a series of dancer rolls and guide rolls 204, one or more of which may be driven to direct the web of film in the direction of the transport path of the packaging machine 200.

Before being formed into the shape of the flexible package 12 for the container 10, the film may be directed through a pre-processing station 206 for additional treatment of the film that may not have been practical or desired at the time the film was prepared and wound onto the film roll 202. The treatments performed at the pre-processing station 206 may include mechanical or laser perforating, scoring or punching or other appropriate processing for defining the flap 22 that may be disposed under the lid fitment 14, application of a peel or pull tab 24 to the flap 22, code dating, applying RFID chips, or any other appropriate pre-processing of the film that should occur at the time the containers 10 are formed. In some embodiments of the packaging machine 200, it may even be desirable to attach the lid fitments 14 at the pre-processing station 206 prior to forming the film into the flexible packages 12. In other embodiments, the pre-processing station 206 may be omitted such that no pre-processing occurs as the sheet of film is unrolled from the film roll 202.

After passing through the pre-processing station(s) 206, the web of film is directed to a forming station 208 having a forming shoulder 210, or other device such as a forming box or sequential folding system, configured to wrap the film around a forming tube 212 in a manner known in the art. In the present example, the forming tube 212 is a product fill tube 214 having a funnel 216 for receiving the product to be disposed in the container 10 and filling the container 10 with the product as the film proceeds along the forming tube 212 as discussed more fully below. The forming tube 212 is configured to form the film into the desired shape based on the characteristics of the final package design, such as square, rectangular, oval, trapezoidal, round, irregular and the like. Depending on the characteristics of the film being processed and/or the container 10 being manufacture and other factors, the film may merely be wrapped completely or partially around the forming tube 12 to shape the film, or folding devices may be used to form creases at the corners 52-56 of the film if more permanent shaping is desired during the initial stages of the package forming process. Of course, where other types of non-VFFS packaging machines are used, a forming tube may not necessarily be used, and instead the film may be wrapped directly around the product to be stored in the container 10.

After the film is formed around the forming tube 212, the web of film moves along the transport path to a combination edge seal/corner seal station 218 to form corner seals 58-62 at the corners 52-56 between the sides 42-48 of the package 12, and to create a combination edge seal and corner seal 64 at the lateral edges 32, 34 of the web of film. In one implementation of the packaging machine 200, the corner seals 56-64 may be formed at the station 218 by providing flat forming plates projecting outwardly from the square or rectangular forming tube 212. The forming plates each extend from a corner of the forming tube 212 in parallel planes that are perpendicular to the surface of the side 42 to which the lid fitment 14 is to be secured and to the opposite side 44 of the package 12 such that two plates extend from the corners defining the lateral edges of the top side 42 and two plates extend from the corners defining the bottom side 44 of the package 12. So that the film properly wraps around the forming plates, the station 218 may further include a shaping bar disposed between each pair of forming plates to shape the film in preparation for sealing the corner seals 58-64. After the web of film passes the forming plates and shaping bars, the web of film is directed past welding devices of the station 218 that weld the overlapping portions of the film at the corners 52-56 and lateral edges 32, 34 to complete the corner seals 58-64. Depending on the configuration of the container 10, the forming plates could project outwardly in planes that are not perpendicular to the surface of the top side 42 such that the corner seals 58-64 are not perpendicular to the top side 42. In such implementations, the base 16 of the lid fitment 14 may be formed with a shape that is complementary to the orientation of the corner seals 58-64.

At one corner of the forming tube 212, portions of the film proximate the lateral edges 32, 34 of the film are joined to form the combination edge seal and corner seal 64. To ensure the integrity of the combined edge seal and corner seal 64 during the use of the container 10, an additional fold may be formed at the corner, with the folded portion being welded to the mating portion of the seal 64 to reinforce the corner seal 64. Downstream of the corner seal welding devices, an additional forming shoulder may be provided to fold a portion of the combination seal 64 formed at the lateral edges 32, 34 inwardly upon itself to overlap the unfolded portion. An additional welding device may be provided to form a second weld at the corner seal 64 after the film passes the forming shoulder to preserve the additional fold. Alternatively, the portion of the corner seal 64 may be folded outwardly and welded in a similar manner. While the present example illustrates the lateral edges 32, 34 meeting at a corner of the package 12 and being welded to form the combination edge seal and corner seal 64, those skilled in the art will understand that the packaging machine 200 may be configured such that the lateral edges 32, 34 meet at any of the corners 52, 56 of the package 12, or at any point along any of the flat surfaces such that a fin seal, a lap seal or other appropriate edge seal is formed separately from the corner seals. In the illustrated example, an edge seal may be formed at one of the corner seals 64 to maximize the amount of printable space available on the exterior of the container 10. As discussed above, the edge seal may be disposed along a side of the package 12 instead of at one of the corners. In such configurations, the station 218 may be configured to form the corner seal 64 in a similar manner as the other corner seals 58-62, and to form a fin, lap or other seal at the intersection of the lateral edges 32, 34. Of course, the corner seals 56-62 and the edge seal may be formed by different work stations depending on the particular configuration of the packaging machine.

In order to further control the movement of the web of film along the forming tube 212 and the transport path, pull belts 220 may be provided after the stations 218 to engage the film and pull the film through the previous stations 206, 208, 218. Once the corner seals 58-64 are formed in the corners of the package 12, the lid fitment 14 may be installed on the package 12 at a desired location and preferably overlying the removable/recloseable flap 22 at a lid application station 222. The lid fitments 14 may be delivered to the lid application station 222 from a supply of lid fitments 14 at a lid bulk hopper 224. Lid fitments 14 from the hopper 224 may be transferred via a lid elevator 226 to a lid sorter/orientator 228. The sorter/orientator 228 is configured to position the lid fitments 14 in the proper orientation for delivery to the lid application station 222. At the outlet of the sorter/orientator 228, the properly oriented lid fitments 14 may be delivered to the lid application station 222 by a lid feed conveyor 230.

At the lid application station 222, the lid fitments 14 are positioned against and secured to the proper location on the packages 12 as the packages 12 pass the lid application station 222 on the forming tube 212. In the present example, the bottom surface 50 of the lid fitment 14 is placed against the top side 42 of the package 12 at the location of the removable flap 22 with front and rear sides 78, 80 of the lid fitment 14 being disposed at corresponding portions of the corner seals 58, 60 defining the edges of the top side 42. When the package 12 is disposed at the proper location adjacent the lid application station 222, a plunger, mandrel or other positioning device of the lid application station 222 may actuate to push the next lid fitment 14 from the lid feed conveyor 230 toward the forming tube 212 with the bottom surface 50 of the lid fitment 14 engaging the surface of the top side 42 of the package 12. The head of the mandrel or plunger may be shaped to conform to the inner recess of the top surface of the lid fitment 14 for properly aligning the lid fitment 14 with the surface of the package 12 and for applying an appropriate amount of pressure to the surface of the film. Once in place, sealing devices of the station 222 may form seals between the front and rear sides 78, 80 of the lid fitment 14 and the corresponding portions of the corner seals 58, 60 of the top side 42. For example, the sealing devices may be heat sealers forming heat seals between the sides 78, 80 of the lid fitment 14 and the corner seals 58, 60 of the package 12. Of course, other types of seals may be formed such that the sides 78, 80 of the lid fitment 14 are sealed to the corner seals 58, 60 such as by heat, time or pressure sealing techniques, adhesive attachment, welding and the like. Moreover, the lid fitment 14 may alternatively be connected to the top side 42 of the package 12 by forming a seal between the bottom surface 50 of the lid fitment 14 and the surface of the top side 42 of the package 12. The particular sealing mechanism and location may be determined based on the particular configurations of the lid fitments 14 and the packages 12 to which they are being attached or based on the processes used to attach the lid fitment 14 to the package 12, and alternative attachment configurations will be apparent to those skilled in the art.

Once the lid fitment 14 is attached, the leading and trailing edges 28, 30 of the package 12 may be sealed to close the package 12, and folded and tacked down to conform the shape of the package 12 to the lid fitment 14. The package 12 with the lid fitment 14 attached passes from the lid application station 222 to a closing station 232. In order to ensure the edges 28, 30 of the package 12 wrap around the lid fitment 14 neatly to form a relatively smooth and uniform outer surface for the container 10, it may be necessary to tuck the film between the corner seals 58-64 on the top and/or bottom sides 42, 44 of the package 12 at the time the leading and trailing seals 70, 72 are formed. To accomplish this, the closing station 232 may include film tuck bars 234 disposed above seal bars 236 of the closing station 232. When the leading edge 28 of the package 12 is aligned at the seal bars 236, the film tuck bars 234 may move inwardly toward the corresponding sides 42, 44 of the package 12 and engage the surfaces of the sides 42, 44 to tuck the sides 42, 44 inwardly as the seal bars 236 move together to engage and seal the leading edge 28 of the package 12. It should be noted that since the packages 12 are being formed from a continuous web of film, the seal bars 236 simultaneously close upon the film and may seal the trailing edge 30 of the preceding package 12. Consequently, additional film tuck bars 234 may be provided below the seal bars 236 to tuck the sides 42, 44 at the trailing edge 30 of the preceding package 12. While not shown in the present process of FIG. 9, in an alternate embodiment the closing station 232 may seal only the leading seal 28 of the upper package 12 and leave the trailing edge 30 of the packages 12 open. For example, the seal bars 236 may be double seal bars that are heated separately to seal either the trailing seal 72 of the bottom package 12 or the leading seal 70 of the upper package 12 if desired. Moreover, the double seal bars may engage separately so that only one of the packages 12 is engaged by the seal bars 236 when the packages 12 pass through the closing station 232.

As discussed above, the forming tube 212 of the illustrated embodiment of the packaging machine 200 is a product fill tube 214. Once the leading edge 28 of the package 12 is closed during the sealing process at the closing station 232, the product may be added to the package 12. At that point, a specified amount of the product may be poured through the funnel 216 into the fill tube 214 and drop into the package 12 where the product is retained due to the seal 70 at the leading edge 28 of the package 12. After or as the package 12 receives the product, the package 12 advances to align the trailing edge 30 of the package 12 at the closing station 232 and the trailing edge 30 is tucked and sealed in the manner described above, thereby sealing the package 12 with the product disposed therein. In some implementations, the additional weight of the product in the package 12 may pull on the film and increase the tightness of the film at the closing station 232. In order to control the tightness in the film while forming the seals 70, 72 at the closing station 232, it may be necessary to provide a lifting mechanism to engage and lift the downstream package 12 sufficiently to relieve some or all of the tension in the film such that the seals 70, 72 are properly formed in the packages 12.

At the same time the seals 70, 72 of the adjacent packages 12 are formed, a gas flushing operation may be performed if necessary to place a desired atmosphere in the package 12. Of course, gas flushing may occur continuously or at other times as the package 12 is formed and filled. Additionally, deflators or inflators, or heated gas or cooled gas may be provided and used during one or more of the previous steps to achieve a desired looseness or tightness to the package 12. Once the package 12 is sealed, it may be detached from the web of film in preparation for any final processing steps and containerization. Consequently, the closing station 232 may further include a knife or other separation device (not shown) proximate the seal bars 236 to cut the common seal 70/72 and separate the adjacent packages 12. Alternatively, the separation may occur at a downstream station. After separation, the package 12 may drop or otherwise be transported to a conveyor 238 for delivery to the remaining processing stations.

The conveyor 238 may include a timing belt or timing chain 240 for maintaining proper spacing between the packages 12 and alignment with the remaining processing stations. Other types of conveyors may be used, such as intermittent motion type conveyor belts, shuttle type transfer devices and the like. If necessary, the conveyor 238 may include guide rails or other package control devices to ensure that the packages are properly aligned and spaced as they move along the conveyor 238. The first station along the conveyor 238 may be a top bag seal folder/sealer station 242. The folder/sealer station 242 may fold the trailing seal 72 and the corresponding loose portion of the film around the lid fitment 14 and outer surface of the relatively stationary portion of the package 12 to conform the loose portion to the outer surfaces of the lid fitment 14 and the package 12, and attach the seal to the outer surface of the package 12. The seal 72 may be attached to the surface of the package 12 using heat, time or pressure sealing techniques, or by applying a hot tack adhesive between the seal and the outer surface, or other welding processes. The loose portion of the film should lay relatively flat and conform to the stationary portion of the package 12 when folded and sealed due to the tucks made in the sides 42, 44 at the time the edge seals 70, 72 were formed. After the trailing seal 72 is sealed to the package 12, the timing belt or chain 240 may reposition the package 12 at a first package turner 244 that may reorient the package 12 for folding and sealing of the leading seal 70. The reorientation may be a 180° rotation of the container to place the leading seal 70 at the top of the package 12. Once the package 12 is rotated, the timing belt or chain 240 may transfer the package 12 to a bottom bag seal folder/sealer station 246 for attaching the leading seal 70 to the outer surface of the package 12 in a similar manner as described for the folder/sealer station 242. Alternatively, the leading seal 70 may be folded and attached without reorienting the package 12 or at the same time as the trailing seal is folded and attached.

Once the seals 70, 72 are attached to the outer surface of the package 12, the lateral sides 84, 86 of the lid fitment 14 may be sealed to the corresponding portions of the corner seal 58, 60 of the package 12 so that the container 10 may properly store and maintain the freshness of the product stored therein after the flap 22 is removed and the package 12 is no longer sealed. In preparation, the timing belt or chain 240 may first position the package 12 at a second package turner 248 that may rotate the package 12 so that the lid fitment 14 is disposed at the top. The timing belt or chain 240 may then move the package 12 to a lid final sealer 250 that may be configured to seal the lateral sides 84, 86 of the lid fitment 14 to the corresponding portions of the corner seals 58, 60 and/or seal the bottom surface 50 of the base 16 to the top surface of the top side 42. The final sealer 250 may perform a similar sealing process as that performed at the lid application station 222, such as heat sealing, adhesive sealing or the like, or other welding processes. If necessary, a post-processing station(s) (not shown) may be included along the conveyor 238 for any additional operations to be performed prior to shipment, such as code dating, weight checking, quality control, labeling or marking, RFID installation, and the like. At the conclusion of the sealing and post-processing activities, the finished containers 10 may be removed from the conveyor 238 by a case packer 252 and placed into a carton 254 for storage and/or shipment to retail customers.

The components of the packaging machine 200 and the steps for forming the containers 10 therein may be rearranged as necessary to properly form the containers 10, and to do so in an efficient and cost-effective manner. For example, if necessary to correctly form and shape the package 12, the lid application station 222 may be positioned upstream of the seal station 218 to apply the lid fitment 14 to the sheet of film 26 prior to forming the corner seals 58-64. Alternatively, to increase efficiency or to compensate for space limitations, for example, it may be necessary or desired to position the lid application station 222 along the conveyor 238 to apply and seal the lid fitment 14 to the package 12 after the package 12 is formed. For example, the lid application station 222 could be positioned upstream of the folder/sealer station 242 to apply the lid fitment 14 to the package 12 prior to attaching the trailing seal 72 to the surface of the package 12. Other configurations of the components of the packaging machine 200 will be apparent to those skilled in the art.

Figure 18:
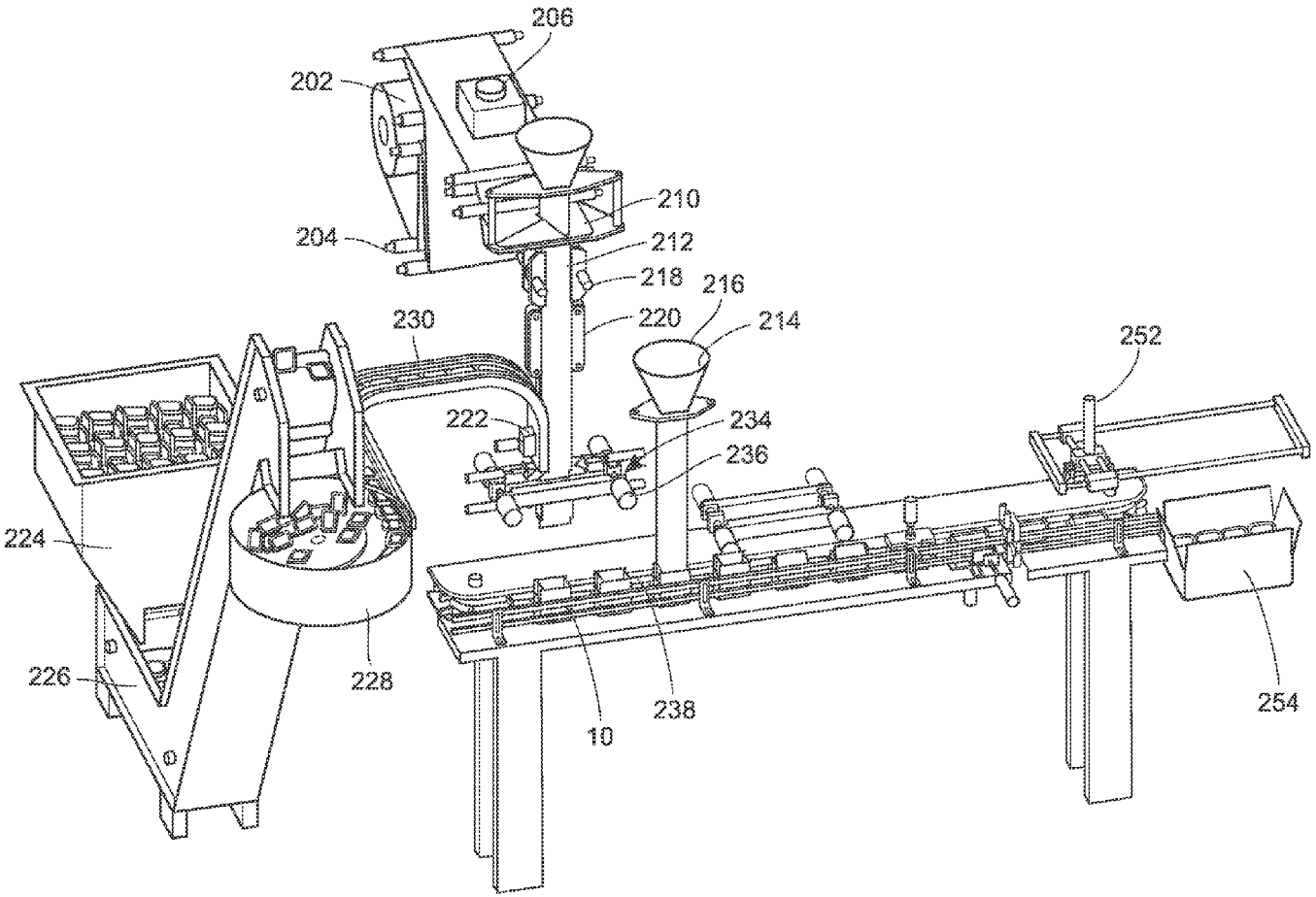
FIG. 18 is a schematic illustration of a further alternative embodiment of a packaging machine configured to produce the flexible, stackable container of FIG. 1 with the container being filled with the quantity of product to be stored therein on the conveyor.

FIG. 18 is a schematic illustration of an alternative embodiment of a packaging machine configured to produce the flexible, stackable container 10 of FIG. 1. The packaging machine in FIG. 10 and many of its components are generally similar to the packaging machine 200 and components of FIG. 9. However, in this embodiment, the product fill tube and funnel are separate from the forming tube and disposed along the conveyor to fill the package 12 after the sheet of film 26 is detached from the web of film. The closing station along the forming tube is configured to form the leading seal 70 of one package 12 without sealing the adjacent trailing edge 30 of the preceding package 12, and to sever the concurrent leading and trailing edges 28, 30 to separate the downstream package 12 from the web of film.

The separated packages 12 having the unsealed trailing edges 30 are transferred to the conveyor via an appropriate active or passive transfer mechanism and disposed along the timing belt or chain with the trailing edges 30 facing upwardly. As the packages 12 are moved into alignment with the lower end of the product fill tube, a specified amount of the product may be poured through the funnel into the fill tube 214 and drop into the package 12. The product-filled packages 12 move along the conveyor to a trailing seal closing station having a pair of seal bars that engage the trailing edges 30 of the packages 12 to form the trailing seal 202 and seal the packages 12. Once sealed, the packages 12 may be conveyed through folder/sealer stations and a lid final sealer station similar to those illustrated and described for the packaging machine of FIG. 17. As a further alternative, the lid application station 222 may be positioned along the conveyor for attachment of the lid fitment 14 at an appropriate location, such as upstream of sealing and folding the trailing seal 72.

Figure 19A:
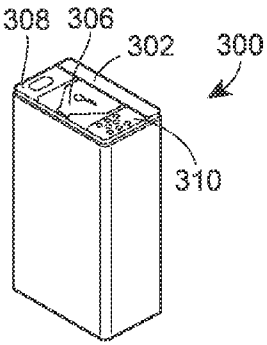
FIGS. 19*a* and 19*b* are isometric illustrations of an alternative embodiment of a flexible, stackable container and lid fitment directed to a spice can.
Figure 19B:
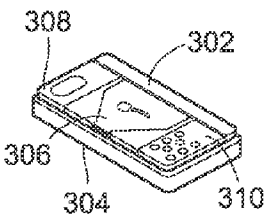

FIGS. 19*a* and 19*b* illustrate an alternate embodiment of a container 300 and lid fitment 302. The lid fitment 302 includes a base 304 that may be similar to the base 16 described above for the lid fitment 14 that may be heat sealed or otherwise attached to the corner seals 58, 60 and/or the surface of the top side 42 of the package 12 and having a central opening for access to a portion of the top surface of the top side 42. In this embodiment, however, the lid fitment 302 may include a plurality of recloseable lids similar to the recloseable lids of a pepper or spice can. For example, the lid fitment 302 may include a first lid 306 that opens to expose a fast pour or free-flowing opening, a second lid 308 that opens to expose a medium pour or large sifting area, and a third lid 310 that opens to expose a slow pour or small sifting area. Each of the lids may have a complementary shape to a portion of the base of the lid fitment to form a seal therebetween when the lid is closed down onto the base 304.

Figure 20A:
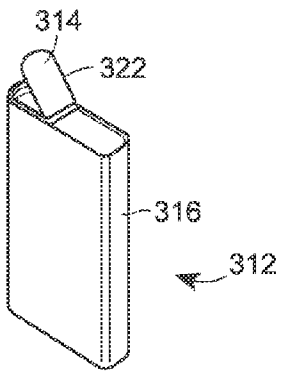
FIGS. 20*a* and 20*b* are isometric illustrations of a further alternative embodiment of a flexible, stackable container and lid fitment directed to a cereal container.
Figure 20B:
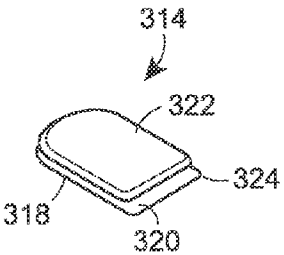

FIGS. 20*a* and 20*b* illustrate a further alternate embodiment of a container 312 and lid fitment 312 that may be particularly applicable to a container in accordance with the present disclosure configured for use as a cereal container. As shown in FIG. 20*a*, the package 316 formed by the packaging machine may be taller and wider than the previously illustrated packages, and components of the packaging machine may be configured to form such a package 316. The lid fitment 314 for the cereal container 312 maybe dimensioned to be applied to only a portion of the top side of the package 316 and form a spout for pouring the cereal out of the container 312. Because the lid fitment 314 does not cover the entire top surface of the top side surrounded by the corner seals, it may be necessary to seal the bottom surface 318 of the base 320 to the surface of the top side to ensure the necessary moisture and aroma barrier is provided when the lid 322 is closed down onto the base 320 to reseal the cereal container 312. The base 320 may further include an outwardly extending flange 324 at the bottom surface 318 to ensure that a sufficient area of contact exists between the bottom surface of the lid fitment 314 and the top surface of the top side to form the necessary seal there between. In other embodiments, the lid fitment 314 for the cereal container 312 may extend across the entire width of the package 316. Such a configuration may be desirable where the cereal container 312 encloses a toy or prize, and the opening of the lid fitment 314 may be dimensioned such that a person may insert their hand into the container 312 to remove the toy or prize without pouring out the cereal or destroying the cereal container 312. It should also be noted again that the lid fitment for the container 312 or other containers in accordance with the present disclosure may be attached to faces of the package other than the top face or side depending on the product to be stored therein and the manner in which the product is to be dispensed. For example, a fitment configured as a pouring spout may be attached to a side surface of a package to facilitate pouring from a salt or liquid container.

Figure 21A:
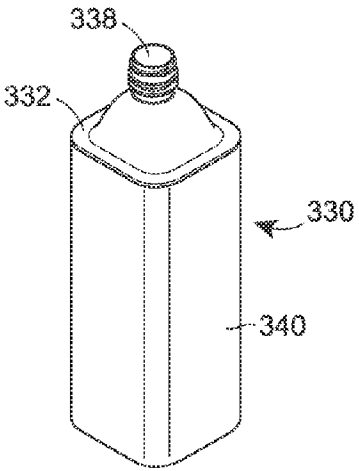
FIGS. 21*a* and 21*b* are isometric illustrations of another alternative embodiment of a flexible, stackable container and lid fitment directed to liquid container.
Figure 21B:
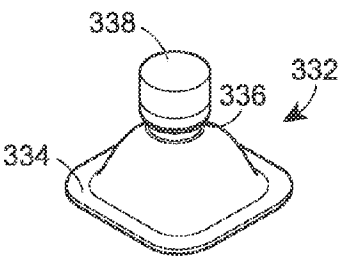

FIGS. 21*a* and 21*b* illustrate a further alternate embodiment of a container 330 and lid fitment 332 that may be particularly applicable to a container in accordance with the present disclosure configured for use as a water bottle or container for other liquids. In contrast to the lid fitments previously illustrated and described herein, the lid fitment 332 for the liquid container 330 may include a base 334 having an externally threaded neck 336, and a detachable lid or cap 338 having internal threads mating with the external threads of the neck 336 so that an appropriate seal maybe formed between the base/neck 334/336 and the cap 338 when the cap 338 is screwed onto the base 334. If necessary, an additional gasket, washer or other appropriate sealing device or tamper-evident feature may be included. The base 334 may extend outwardly toward the corner seals of the package 340 so that the bottom surface may be sealed to the top surface of the top side of the package 340 with sufficient area of contact to form the necessary seal therebetween. Alternatively, the sides of the base 334 may be sealed to the corner seals. The top side of the liquid container 330 may include an easy-opening feature similar to those previously discussed that may be configured to be accessible through neck 336 when the cap 338 is removed to open that package 340 and allow the liquid contained therein to be poured out. Alternatively, the packaging machine may be reconfigured to include a punch or other device for punching a hole in the top side of the package before the lid fitment 332 is sealed thereto so that the liquid may be poured out when the cap 338 is unscrewed from the neck.

Figure 22A:
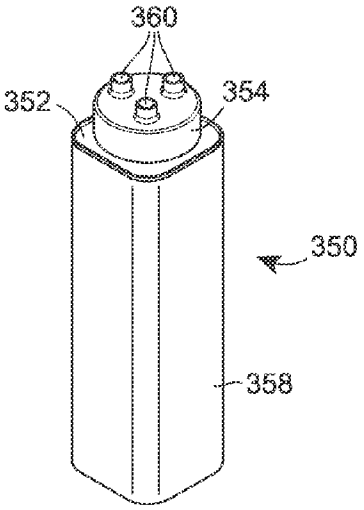
FIGS. 22*a* and 22*b* are isometric illustrations of a still further alternative embodiment of a flexible, stackable container and lid fitment directed to a condiment dispenser.
Figure 22B:
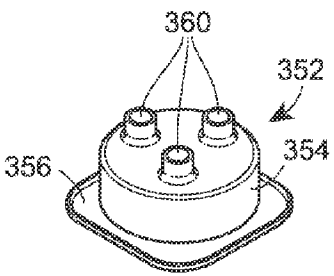

FIGS. 22*a* and 22*b* illustrate an alternate embodiment similar to the liquid container 350 of FIGS. 21*a* and 21*b* in the form of a condiment bottle 350 having a removable spout 354. As with the liquid container 330 of FIGS. 21*a* and 21*b*, the lid fitment 352 of the condiment container 350 may include a base 356 having an externally threaded neck, and a detachable cap 354 having internal threads mating with the external threads of the neck. If necessary, an additional gasket, washer or other appropriate sealing device or tamper-evident feature may be included. The base 356 may extend outwardly toward the corner seals of the package 358 so that the bottom surface may be sealed to the top surface of the top side of the package 358 with sufficient area of contact to form the necessary seal therebetween. Alternatively, the sides of the base 356 may be sealed to the corner seals in a similar manner as discussed above. Three spouts 360 are shown on the cap 354, but fewer or more spouts 360 may be provided, and the spouts 360 may be spaced about the cap 354 as shown or in another desired pattern (multiple rows, concentric circles, etc.), or arranged in-line or collinearly if desired.

Figure 23A:
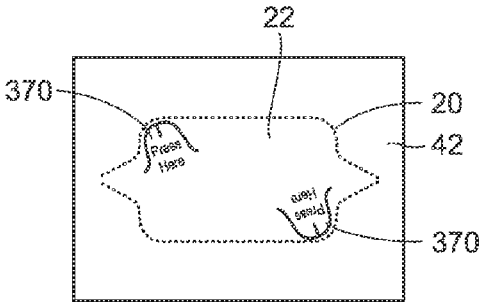
FIGS. 23*a* and 23*b* are multiple plan views of an easy-opening feature that may be implemented in the flexible, stackable container of FIG. 1.
Figure 23B:
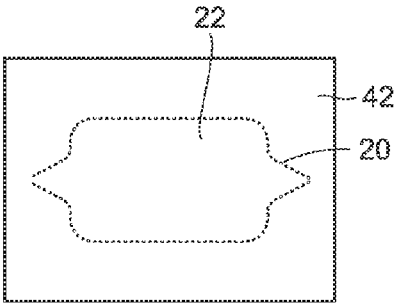

FIGS. 23*a* and 23*b* provide a graphical illustration of an embodiment of an easy-opening feature for the top side 42 of the flexible, stackable containers, such as the container 10 of FIG. 1. A series of perforations 20 to an approximate maximum depth of 50% of the thickness of the film sheet 26 are made in a manner that defines the shape of the flap 22. Indicia 370 may be visible from the outer surface of the top side 42 on the flap 22 and may indicate to a user the location at which to apply pressure to detach the flap 22 from the top side 42. A greater frequency of perforations 20, such as approximately 66.7 perforations per inch, may be provided proximate the indicia 370 to initiate the detachment of the flap 22, while a relatively lower frequency of perforations 20, such as approximately 20.4 perforations per inch, may be provided along the remainder of the line of perforations 20 defining the flap 22. When pressure is applied, the sheet of film 26 yields at the perforations 20 to breach the outer surface of the package 12 and expose the interior of the package 12. If desired, the flap 22 may be pulled outwardly for complete detachment from the package 12. Other penetration depths, shapes, spacing, etc. for the perforations 20 and flap 22 are contemplated by the inventors. For example, the depth of the perforations may be a factor of the materials and the film structure of the film sheet 26. For some films, 50% percent penetration may be adequate for detachment of the flap 22, while other films may require more or less penetration for the perforations 20.

Figure 24A:
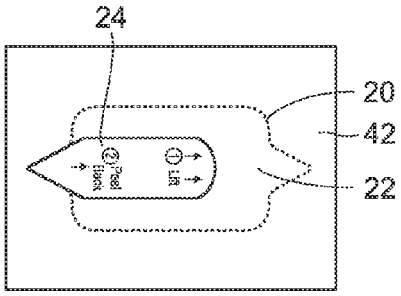
FIGS. 24*a*-24*c* are multiple plan views of an alternative embodiment of an easy-opening feature that may be implemented in the flexible, stackable container of FIG. 1.
Figure 24B:
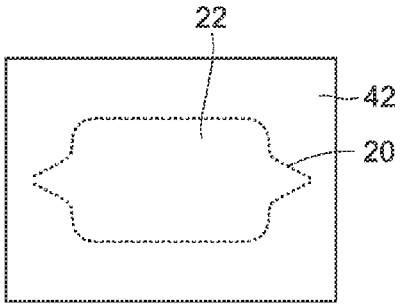
Figure 24C:
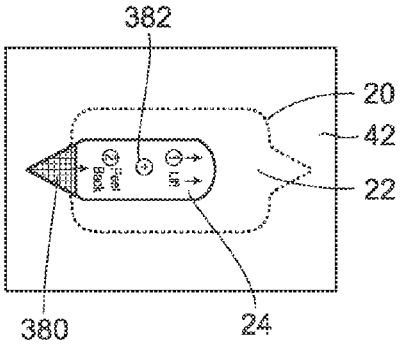

FIGS. 24*a*-24*c* illustrate an alternative embodiment of an easy-opening feature for the top side 42 of the flexible, stackable container 10 of FIG. 1. In this embodiment, the flap 22 may be defined by perforations 20 in a similar manner as in the previous embodiment. The feature may further include the pull tab 24 to be used to pull up on the flap 22 and separate the flap 22 from the sheet of film 26. The pull tab 24 may have a portion 380 welded or otherwise tightly sealed to the flap 22, and an additional tack seal area 382 that may hold the pull tab 24 against the outer surface of the sheet of film 26 as the container 10 is formed. When the lid 18 of the lid fitment 14 is opened, the pull tab 24 may be pulled to detach the flap 22. The relatively weak tack seal area 382 may detach as the pull tab 24 is pulled, but the stronger seal at the welded portion 380 may hold such that the perforations 20 defining the flap 22 yield before the weld separates to detach the flap 22 from the package 12. The frequency of perforations 20 may be adjusted accordingly to ensure that the flap 22 begins to separate from the sheet of film 26 in the desired location, such as proximate the welded portion 380 of the pull tab 24.

Figure 25A:
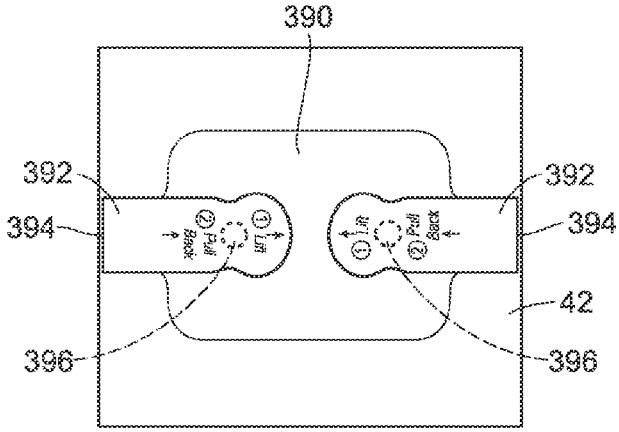
FIGS. 25*a*-25*c* are multiple plan views of a further alternative embodiment of an easy-opening feature that may be implemented in the flexible, stackable container of FIG. 1.
Figure 25B:
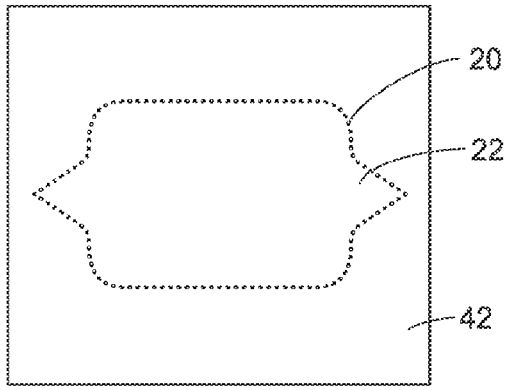
Figure 25C:
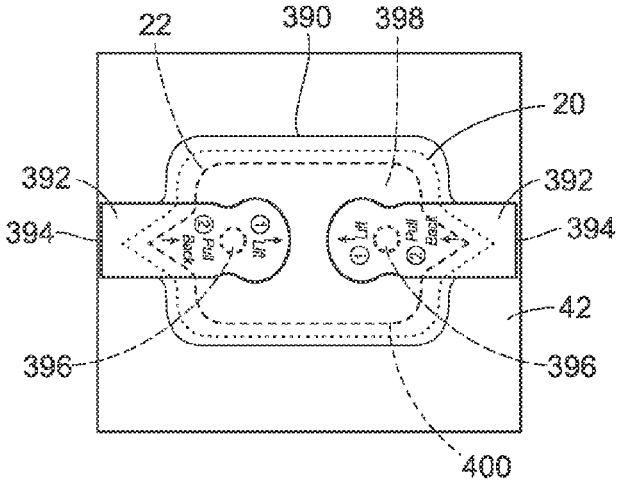

FIGS. 25*a*-25*c* graphically illustrate a further alternative embodiment of an easy-opening feature for the top side 42 of the flexible, stackable container 10 of FIG. 1. In this embodiment, the flap 22 may be defined by perforations 20 penetrating 100% through the sheet of film 26 and defining the flap 22. The feature may further include the pull tab in the form of a cover portion 390 formed from foil or another appropriate material and having a complimentary geometric shape but being larger than the flap 22 so that the cover portion 390 of the pull tab extends beyond the edges of the flap 22 with tabs 392 being folded over at folds 394 to form the graspable portions of the pull tab. Tack seal areas 396 may hold the tabs 392 to the top surface of the cover portion 390 as the container 10 is being formed. The area 398 of the cover portion 390 overlying the flap 22 may be secured thereto with a lock-up seal that will not detach when the flap 22 is pulled free of the sheet of film 26. The lock-up seal area 398 may extend to the perforations 20, or may be disposed inwardly from the perimeter of the flap 22. The portions of the pull tab 24 extending beyond the lock-up seal area 398 may be attached to the outer surface of the top side 42 to form a peelable seal area 400, such as that formed by a pressure sensitive adhesive or other similar coating. When the pull tab is initially attached to the top side 42, the cover portion 390 completely overlies the flap 22 with the peelable seal area 400 serving to seal the package 12 despite the full penetration of the perforations 20. Moreover, the cover portion 390 covers the perforations 20 to prevent the perforations 20 and air or liquids that may be able to pass there through from affecting the barrier properties of the film sheet 26. After the pull tab is pulled to separate the flap 22 from the sheet of film 26, the flap 22 and cover portion 390 may be pressed back down onto the top side 42 such that the peelable seal is reformed around the opening created by the detachment of the flap 22 to re-seal the package 12 and provide a level of barrier protection for the product stored therein. However, the seal may be configured to detach when the pull tab 24 is pulled open, but not reform a seal when the cover portion 290 is pressed back down, such as where the cover portion 290 is heat sealed to the top side 42 of the sheet of film 26.

Figure 26A:
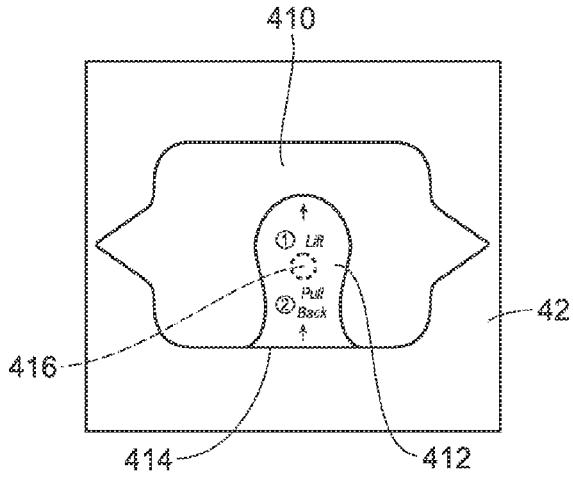
FIGS. 26*a*-26*c* are multiple plan views of another alternative embodiment of an easy-opening feature that may be implemented in the flexible, stackable container of FIG. 1.
Figure 26B:
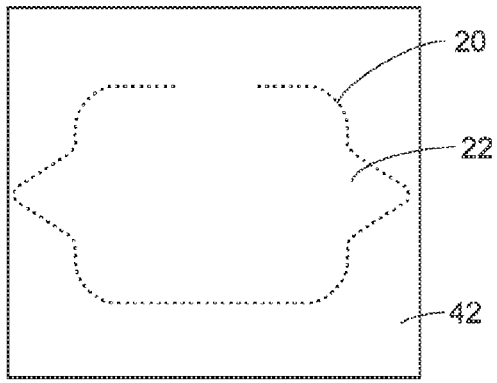
Figure 26C:
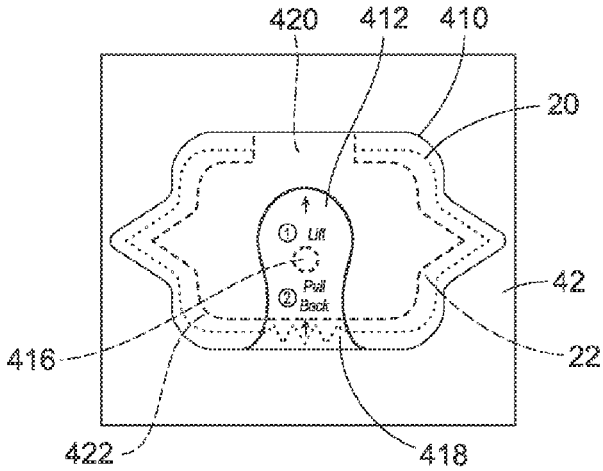

FIGS. 26*a*-26*c* graphically illustrate another alternative embodiment of an easy-opening feature for the top side 42 of the flexible, stackable container 10 of FIG. 1. The easy-opening feature includes the flap 22 and a cover portion 410 of a pull tab in similar configurations as in FIGS. 25*a*-25*c*, but configured so the flap does not completely detach from the film sheet 26 during normal use. The perforations 20 may extend most of the way but not entirely around the entire periphery of the flap 22. The cover portion 410 also includes a single tab 412 folded back over a fold 414 and held down by a tack seal area 416. The tab 412 may be disposed opposite the side of the flap 22 that is not perforated. The perforations 20 may also be provided at the peel tab area in a zig-zag configuration 418 to create a point of weakness at which the tearing or peeling of the flap 22 will be initiated. Of course, other configurations of the perforations 20 may be used to create the point of weakness, such as larger and/or deeper perforations, and other geometric configurations of perforations 20, including configurations having a higher density of perforations 20 at the pull tab area. The cover portion 410 further includes a lock-up seal area 420 attached to the flap 22 within the area defined by the perforations, and a peelable seal area 422 extending beyond the flap 22. When the tab 412 is pulled, the flap 22 does not completely detach from the sheet of film 26 and the flap 22 and cover portion 410 are not completely removed from the package 12. Configured in this way, the flap 22 and cover portion 410 are properly aligned with the opening in the top side 42 of the package 12 when they are replaced over the opening to reclose and seal the package 12.

Figure 27A:
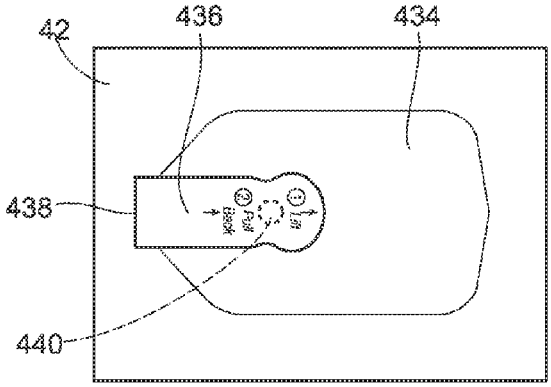
FIGS. 27*a*-27*c* are multiple plan views of a still further alternative embodiment of an easy-opening feature that may be implemented in the flexible, stackable container of FIG. 1.
Figure 27B:
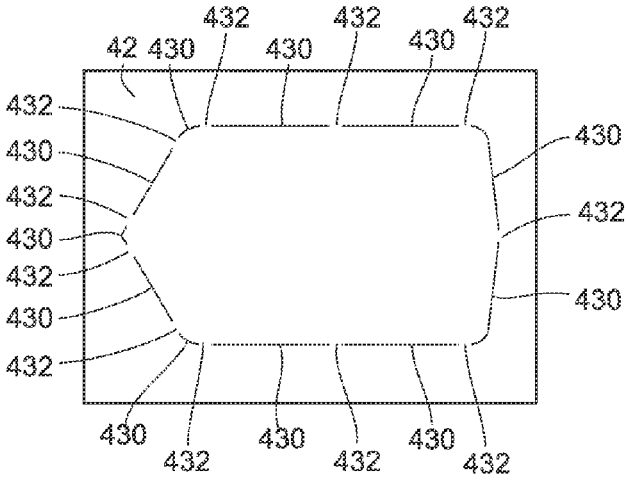
Figure 27C:
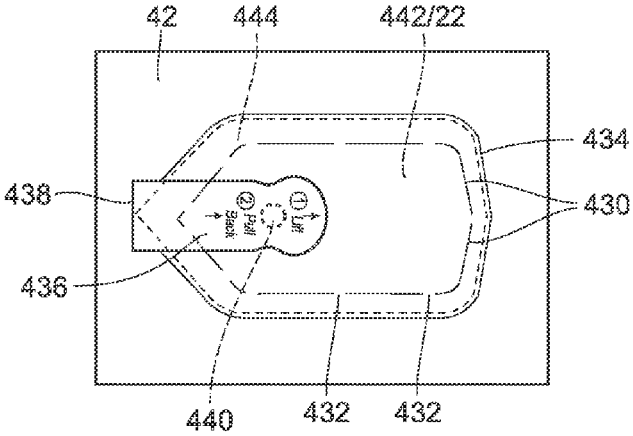

FIGS. 27*a*-27*c* graphically illustrate a still further alternative embodiment of an easy-opening feature for the top side 42 of the flexible, stackable container 10 of FIG. 1. In this embodiment, the flap 22 may be defined by a line of reduced strength formed by a series of alternating score lines 430 and interruptions in the scoring or bridges 432. The score lines 430 may have full penetration through the film sheet 26, while the bridges 432 are areas of no penetration, or of partial penetration but less than 100% penetration such that the bridges 432 maintain the attachment of the flap 22. The length of the score lines between the bridges may range from 0.1" to 2.0", and the length of the bridges may fall within the range of 0.002" to 0.090" depending on the implementation. The pull tab may be similar to that shown in FIGS. 25*a*-25*c*, and include a cover portion 434 overlying the flap 22, and with a single tab 436 folded back over a fold 438 and held down by a tack seal area 440. A lock-up seal area 442 of the cover portion 434 may be attached to the film sheet 26 at the flap 22, and may extend to the score lines 430 as shown, or may be disposed inwardly from the perimeter of the flap 22. A peelable seal area 444 extends beyond the lock-up seal area 442 and may be attached to the outer surface of the top side 42 with a pressure sensitive adhesive or other similar coating. When the pull tab is initially attached to the top side 42, the cover portion 434 completely overlies the flap 22 with the peelable seal area 444 serving to seal the package 12 despite the full penetration of the score lines 430. The tab 436 is pulled away from the top side 42 of the package 12 to detach the flap 22 at the bridges 432 for removal of the flap 22 and cover portion 434. If desired, the flap 22 and cover portion 434 may be pressed back down onto the top side 42 such that the peelable seal is reformed around the opening created by the detachment of the flap 22 to re-seal the package 12. Depending on the adhesive being used, the configurations of the score lines and the bridges and the properties of the film sheet 26, the same adhesive or same type of seal may be used in both the lock-up seal area 442 and the peelable seal area 444 if the strength of the adhesive is sufficient to detach the flap 22 at the bridges without the cover portion 434 separating from the flap 22.

Figure 28A:
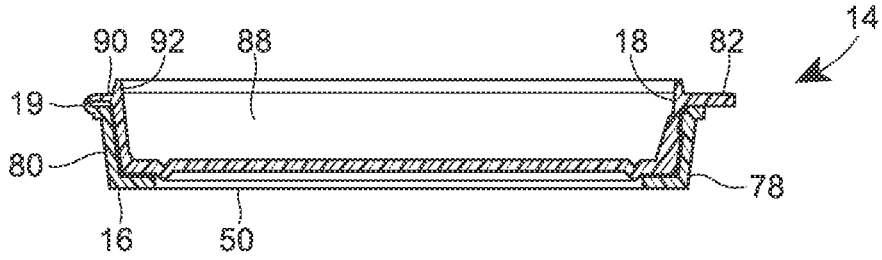
FIGS. 28*a*-28*c* are cross-sectional views of embodiments of the lid fitment of FIG. 2 taken through line 28-28.

As discussed previously, containers in accordance with the present disclosure such as those described herein may be stacked efficiently side-by-side in shipping cartons and on display shelves, and may be stacked vertically on top of each other. To facilitate vertical stacking, the bottom sides of the packages and the top surfaces of the lid fitments may be configured with complimentary shapes fostering stability in stacking the containers. Referring to FIG. 28*a*, the embodiment of the lid fitment 14 of FIG. 2 is shown in cross-section. The lid 18 and the base 16 of the lid fitment 14 have complimentary generally concave shapes so that the lid 18 nests within the base 16 and forms the necessary seal for the container 10. The lid 18 has an outer wall 88 extending around the lid 18 and having an upper edge 90 upon which the bottom side 44 of a container 10 stacked thereupon will rest. For the container 10 of FIGS. 2-8, the corner seals 62, 64 of the package 12 are aligned with the upper edge 90 of the lid 18. If necessary, the lid 18 may include an additional rim 92 extending upwardly from the upper edge 90 of the outer wall 88 and having its outer edge disposed inwardly from the outer edge of the outer wall 88 such that the corner seals 62, 64 slide over the rim. In some embodiments, the rim 92 may be disposed approximately one-eighth inch inwardly from the outer edge of the outer wall 88, and may extend approximately one-eighth inch upwardly from the upper edge 90 of the outer wall 88. The engagement between the rim and the corner seals 62, 64 may prevent relative horizontal movement between the stacked containers 10 that may cause instability of the stack.

Figure 28B:
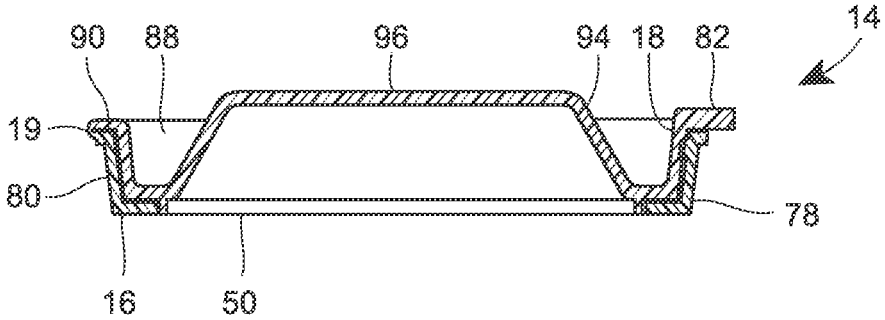

FIG. 28*b* illustrates an alternative embodiment of the lid fitment 14 that may further promote stable stacking of the containers 10 having corner seals 62, 64. Depending on the density of the product stored in the package 12, the bottom side 44 of the package 12 may tend to sag under the weight of the product because the bottom side 44 is normally disposed above the bottom edges of the corner seals 62, 64. To provide additional support for the bottom sides 44 when the containers 10 are stacked, the lid 18 may have an upwardly extending central raised portion 94 with a top surface 96 that is higher than the upper edge 90 of the outer wall 88. The vertical distance between the top surface 96 and the upper edge 90 may typically be less than or equal to the height of the corner seals 62, 64. Consequently, in some implementations the top surface 96 may be in the range of 1/16" to 1/4" above the upper edge 90. When one container 10 is stacked on another, the bottom side 44 of the upper container 10 may sag, but the central portion 94 of the lid 18 of the lower container 10 will prevent the bottom side 44 from sagging below the bottom edges of the corner seals 62, 64.

Figure 28C:
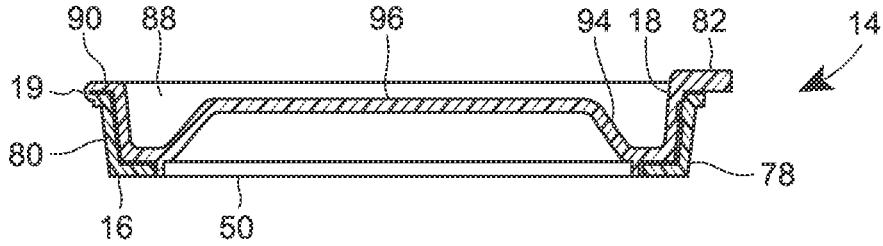

The bottom sides 122 of the containers of FIGS. 9-16 may also sag when stacked on the lid 19 of the lid fitment 14 of FIG. 28*a*. Consequently, additional support for the bottom sides 122 may also be necessary. FIG. 28*c* illustrates a further alternative embodiment of the lid fitment 14 wherein the top surface 96 of the central portion 94 of the lid 18 is raised. However, in this embodiment the top surface 96 is disposed lower than the upper edge 90 of the outer wall 88 to allow an acceptable amount of sagging of the bottom side 122 to occur. Similar to the embodiment of FIG. 28*b*, the top surface 96 may be in the range of 1/16" to 1/4" below the upper edge 90 in some implementations. When one container is stacked on another, the bottom side 122 of the upper container may sag, but the central portion 94 of the lid 18 of the lower container will prevent excessive sagging of the bottom side 122. Other configurations of support structures of the lids 18 for providing additional support of a container stacked thereon will be apparent to those skilled in the art and are contemplated by the inventors as having use with containers in accordance with the present disclosure.

Figure 29:
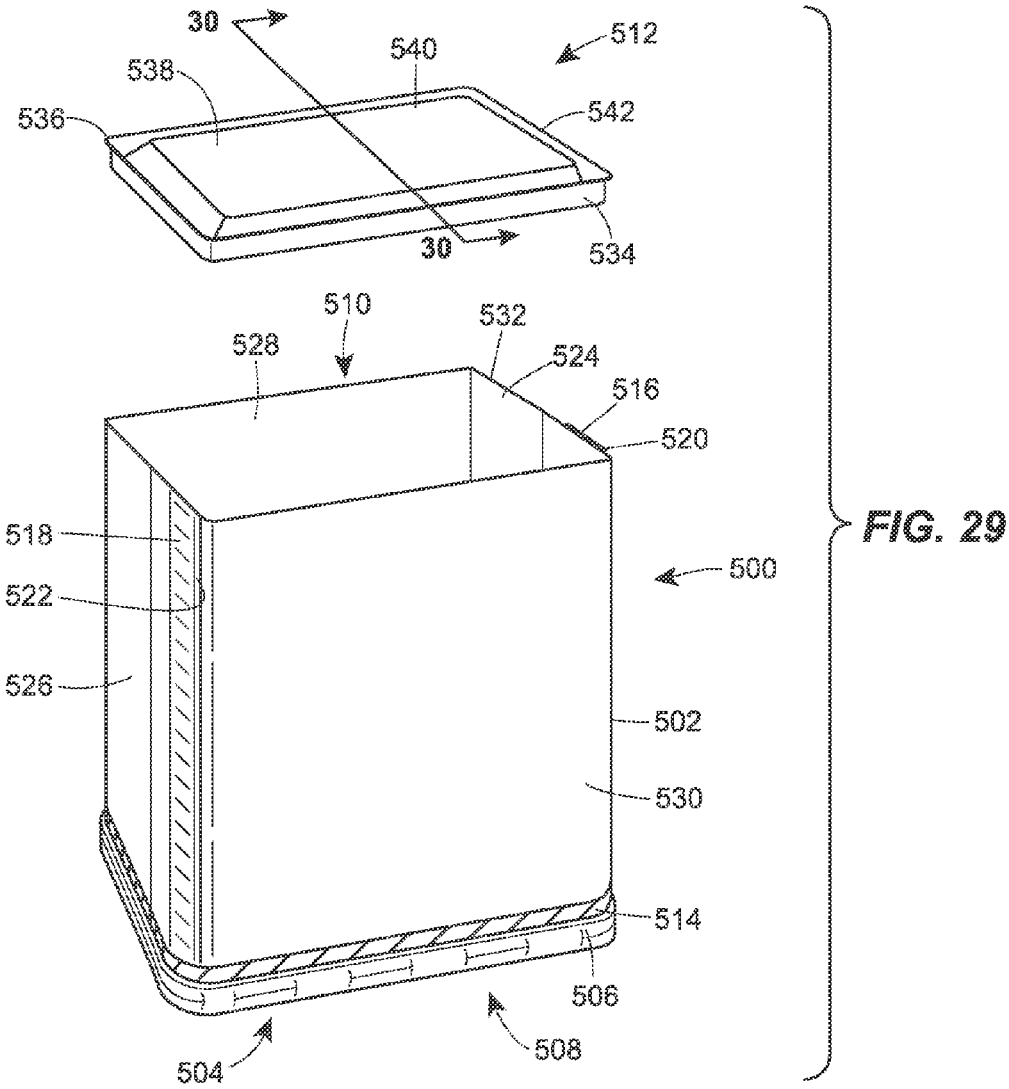
FIG. 29 is a partially exploded isometric vie of an alternative embodiment of a flexible, stackable container in accordance with the present disclosure.
Figure 30:
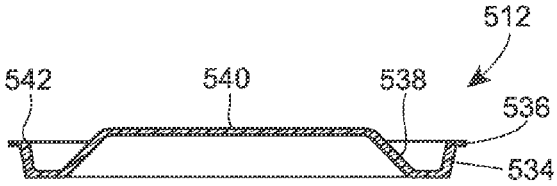
FIG. 30 is a cross-sectional view of the bottom fitment of the flexible container of FIG. 29 taken through line 30-30.
Figure 31:
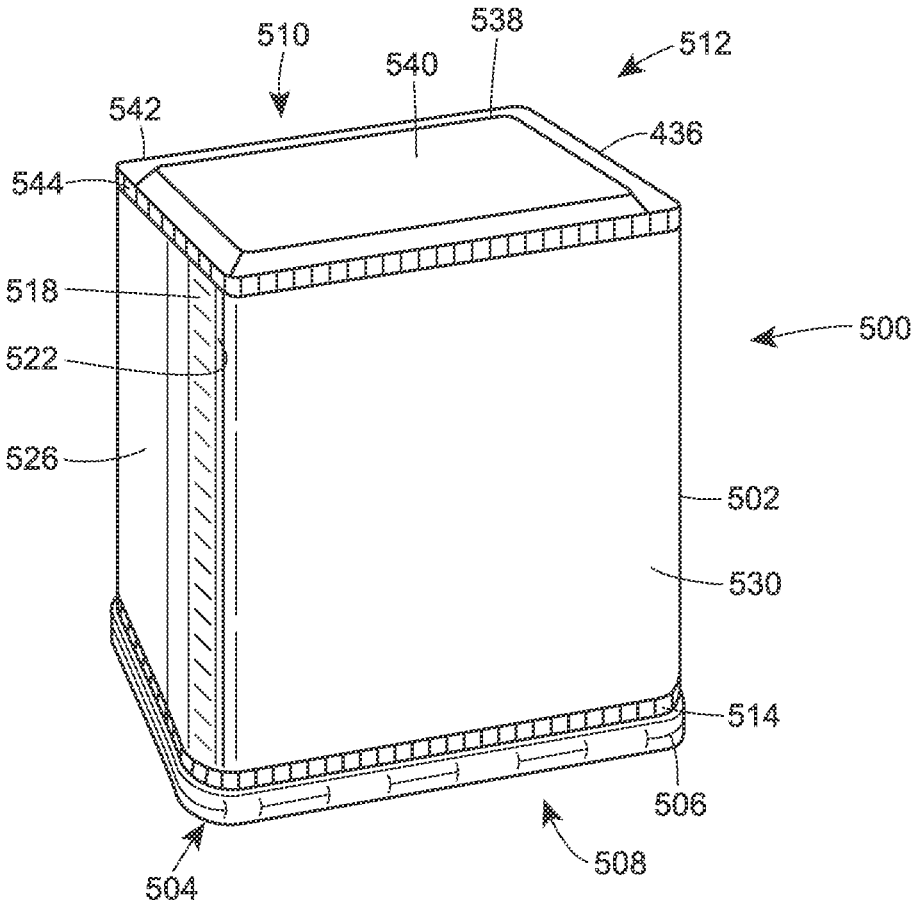
FIG. 31 is an isometric view of the flexible container of FIG. 29 fully assembled.

Alternative configurations of flexible containers are contemplated that may provide similar benefits of efficient packaging and display, reduced weight, and biodegradability. FIGS. 29-31 show one example of a container 500 having a generally similar configuration as the container 10 of FIGS. 1-8, but with several modifications discussed further herein. Referring to FIG. 29, which is a partially exploded view of the container 500 in an inverted position, the container 500 includes a package 502 formed of a sheet of film and having a lid fitment 504 with a recloseable lid 506 attached at a top side 508 thereof. The package 502 is generally the same as the package 12 of the container 10, but with a bottom side 510 being open prior to the attachment of a bottom fitment 512 as will be discussed further below. The package 502 may include corner seals 514 defining the top surface of the package 502 and having the lid fitment 504 attached thereto in a similar manner as the lid fitment 14 is attached to the corner seals 58, 60 and/or the top side 42 of the package 12. The package 502 may further include leading and trailing seals 516, 518 formed at leading and trailing edges 520, 522, respectively, of the film sheet, and folded over and attached to lateral sides 524, 526, respectively, of the package 502. The front and rear sides 528, 530 of the package 502 provide continuous surfaces for printing product information thereon. As discussed above, while the container 500 is illustrated as having the lid fitment 504 attached to the top side 42 of the package 502 and perforations 20 or scoring may be applied to the sheet of film at the top side 42 to define a flap 22, the lid 42 and/or flap 22 may alternatively be disposed on any of the other sides 524-530 of the package 502 if desired to form the container 500.

The package 502 may be formed using generally similar process steps as the package 12 of the container 10. A sheet of film may be wrapped inwardly, such as around a forming tube, and creased to form corners between the top side 508 and the front and rear sides 528, 530. However, in this embodiment, the sheet of film may not include portions of film for forming a bottom side of the package 502. Instead, the lateral edges of the sheet of film form the respective bottom edges 532 of the sides 528, 530 and the package 502. The corner seals 514 may then be formed at the front and rear corners of the top side 508, and the leading and trailing edge seals 516, 518 may be formed, folded over and attached in any appropriate manner, such as those discussed previously. At an appropriate point in the process, the lid fitment 504 may be attached at the top side 508.

With package 502 being formed with an open bottom side 510, the package 502 may be reoriented as shown in FIG. 29 for filling and attachment of the bottom fitment 512. It should be noted at this point that the package 502 may but need not be formed on a VFFS machine. Any appropriate equipment for folding the film sheet and forming the seals 514, 516, 518 may be used to form the package 502. Consequently, reorientation of the package 502 may not be required to have the bottom side 510 face upward. However, once the bottom side 510 faces upwardly, the desired quantity of the product to be stored in the container 500 may be deposited in the package 502 through the bottom side 510.

The bottom fitment 512 may be formed with a complimentary shape to the bottom side 510 of the package 502 so that the bottom fitment 512 may be inserted at the bottom edges 532 and secured thereto. The configuration of the bottom fitment 512 is shown more fully in cross-section at FIG. 30. The bottom fitment 512 may include an outer wall 534 that is inserted into and engaged by the film at the bottom edges 532 of the package 502. The outer wall 534 may include an outwardly extending lip 536 that may be engaged by the bottom edges 532 to prevent the bottom fitment 512 from being pushed into the package 502. As discussed, the bottom fitment 512 may also have a complimentary shape to that of the package 502. Moreover, the bottom fitment 512 may also have a complimentary shape to the lid fitment 504 to facilitate stable stacking of the containers 500. To this end, the bottom fitment 512 may include a central raised portion 538 (lowered portion 538 when the container 500 is upright) within the outer wall 534, and having a bottom surface 540 that may engage a corresponding top surface of the lid fitment 504 of the container 502 on which another container 502 is placed. Where the lid fitment 504 is configured as the lid fitment 14 of FIG. 28*a*, the bottom surface 540 may extend beyond a bottom edge 542 of the bottom fitment 512 and down upon the top surface of the lid fitment 504. Conversely, where a top surface of the lid fitment 504 extends above an upper edge of the lid fitment 504, the bottom surface 540 may be within the bottom edge 542 of the bottom fitment 512 so that the raised portion of the lid fitment 504 may be received within the outer wall 534 of the bottom fitment 512. Moreover, the lid fitment 504 and/or the bottom fitment 512 may include a rim such as the rim 92 of the lid fitment 14 that engages a fitment of an adjacent container 500 to prevent destabilizing lateral relative movement when the containers 500 are stacked on one another.

Turning to FIG. 31, the bottom fitment 512 may be inserted into the bottom side 510 of the package 502 after the product is deposited therein. However, depending on the manufacturing processes used to assemble the container 500, the bottom fitment 512 may be attached before one or both of the leading and trailing edge seals 516, 518 is formed. The outer wall 534 is engaged by the film of the package 502 proximate the bottom edge 532, and the film is sealed to the outer wall 534 of the bottom fitment 512 to form a bottom seal 544 using an appropriate sealing technique, such as those described above. As with the seals of the package 10, the bottom seal 544 may be any type of seal sufficient to retain the product within the container 500 and to provide any necessary boundary characteristics or barrier properties. Further, the bottom fitment 512 may be made from any appropriate material having the necessary properties to be sealed to the film of the package 502. For example, the bottom fitment 512 may be made from a plastic material, such as polyester (PE), polyethylene terephthalate (PETE), polylactic acid (PLA), polyvinyl chloride (PVC), polystyrene (PS), polypropylene (PP), and the like, by means of an appropriate forming process, such as thermoforming, injection molding, casting or blow molding.

Figure 32:
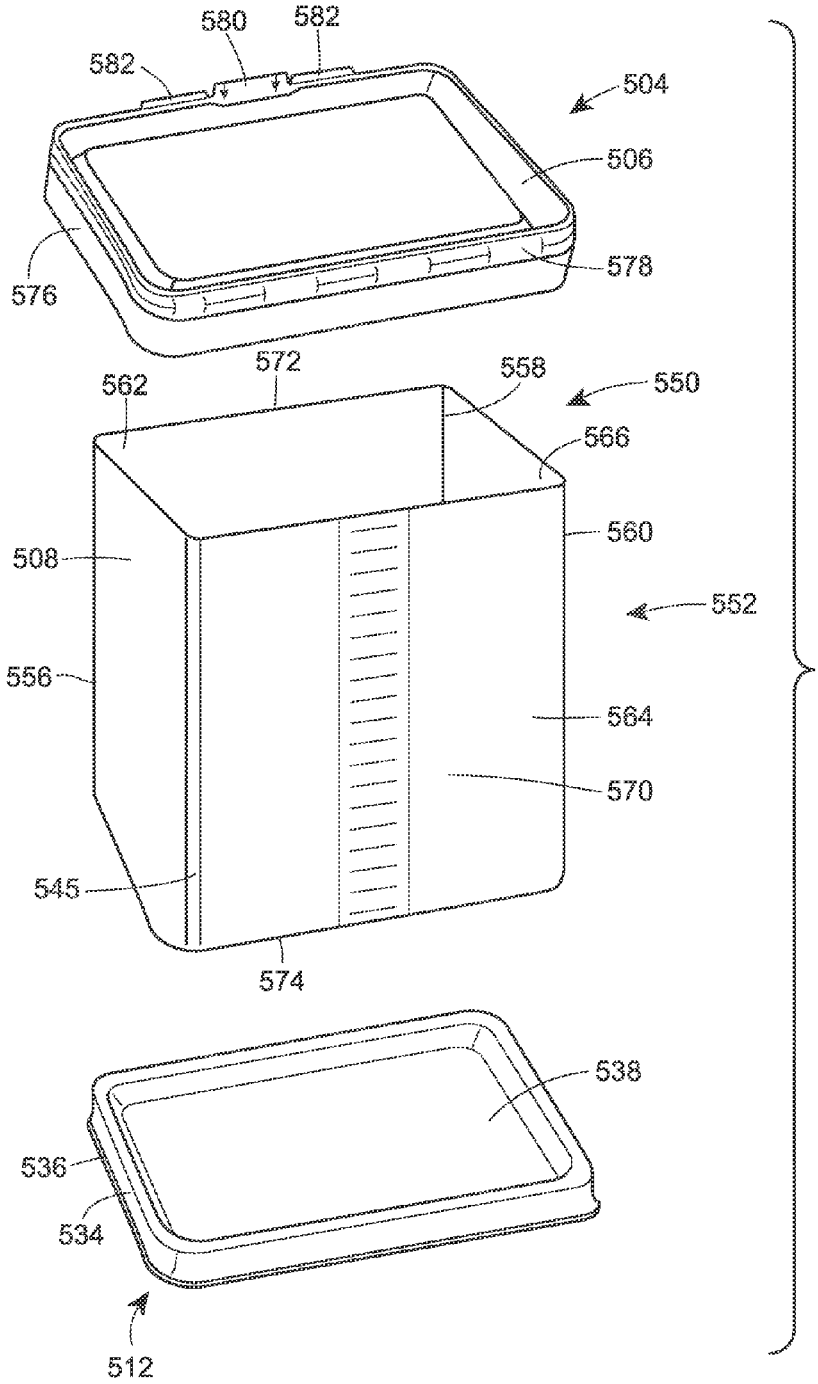
FIG. 32 is an exploded isometric view of a further alternative embodiment of a flexible, stackable container in accordance with the present disclosure.

FIGS. 32-35 illustrate the components of another alternative embodiment of a flexible, stackable container 550 in accordance with the present disclosure. The container 550 includes a package 552 formed from a sheet of material, along with a lid fitment 504 and a bottom fitment 512 as described above. Turning to FIG. 32, which is an exploded view of the components of the container 550, the package 552 is formed from a single piece of material folded inwardly, such as around a forming tube or mandrel, at four corners 554-560 to form front, rear and lateral sides 562-568. The lateral edges of the sheet of film meet at the rear side 564 of the package 552 and are joined together at a rear seal 570 to form the tubular package 552. The rear seal 570 may be any appropriate seal between the portions of the sheet of film proximate the lateral edges, such as a fin seal wherein the inner surfaces of the film proximate the lateral edges are seal together and folded over and attached to the exterior surface of the film, or a lap seal wherein the portions of the sheet of film are overlapped and sealed together. The rear seal 570 may be disposed within the rear side 564 as shown, or may be formed in another one of the sides or proximate one of the corners 554, 560 to maximize the printable surface area of the rear side 564 if desired.

In contrast to the containers 10, 500 discussed previously, the package 552 of the container 550 may not include either a top side or a bottom side. Instead, the package 552 has a top edge 572 and a bottom edge 574 that remain open to receive the lid fitment 504 and the bottom fitment 512, respectively, therein. The bottom lid fitment 512 may be inserted into the bottom edge 574 of the package 552 and attached to the portion of the sheet of film proximate the bottom edge 574 in a similar manner as described above for the container 500. At the opposite end of the package 552, the lid fitment 504 may be inserted into the top edge 572 and attached in a similar manner. The lid fitment 504 is similar to the lid fitment 14 described in greater detail above. The lid fitment 504 includes a base 576 to which the lid 506 may be attached by a living hinge 578 so that the lid 506 may be opened and reclosed to alternately permit access to the interior of the container 550 and close the container 550 to retain the product therein. The embodiment of the lid fitment 504 also illustrates the configuration of the lid fitment 504 with a grip 580 at the front side of the lid 506 and leverage tabs 582 of the base disposed on either side of the grip 580. The leverage tabs 582 may facilitate opening of the lid 506 by allowing a user to press upwardly on the grip 580 and downwardly on one of the leverage tabs 582 to separate the lid 506 from the base 576. As with the previously discussed embodiment, the lid fitment 504 and bottom fitment 512 may have complimentary configurations to facilitate stable stacking of the containers 550 for shipping and display.

Figure 33:
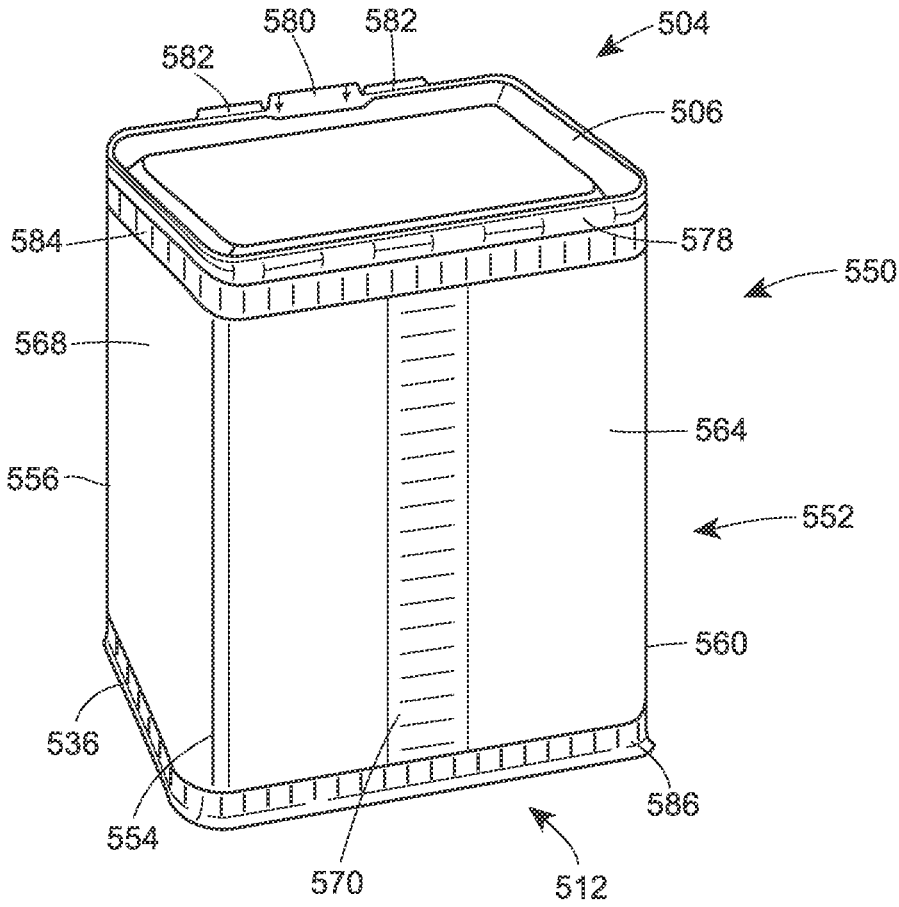
FIG. 33 is an isometric view of the flexible container of FIG. 32 fully assembled.

Referring to FIG. 33, the top fitment 504 is inserted at the top edge 572 of the package 552 and the bottom fitment 512 is inserted at the bottom edge 574 of the package 552 to form the container 550. After the base 576 is inserted at the top edge 572, an appropriate top seal 584 is formed between the base of the top fitment 504 and the corresponding portion of the sheet of film proximate the top edge 572. Similarly, an appropriate bottom seal 586 is formed between the outer wall 534 of the bottom fitment 512 and the corresponding portion of the sheet of film proximate the bottom edge 574. Depending on the manufacturing requirements or constraints, the lid fitment 504 and the bottom fitment 512 may be attached in either order after the package 552 is formed. After a first one of the fitments 504, 512 is attached to the package 552, the container 550 may be oriented if necessary to received the product to be stored therein, the appropriate quantity of the product may be deposited in the package 552 through the still open end of the container 550, and the other of the fitments 504, 512 may be attached at the corresponding end of the package 552 to close the container 550 and retain the product therein.

Figure 34:
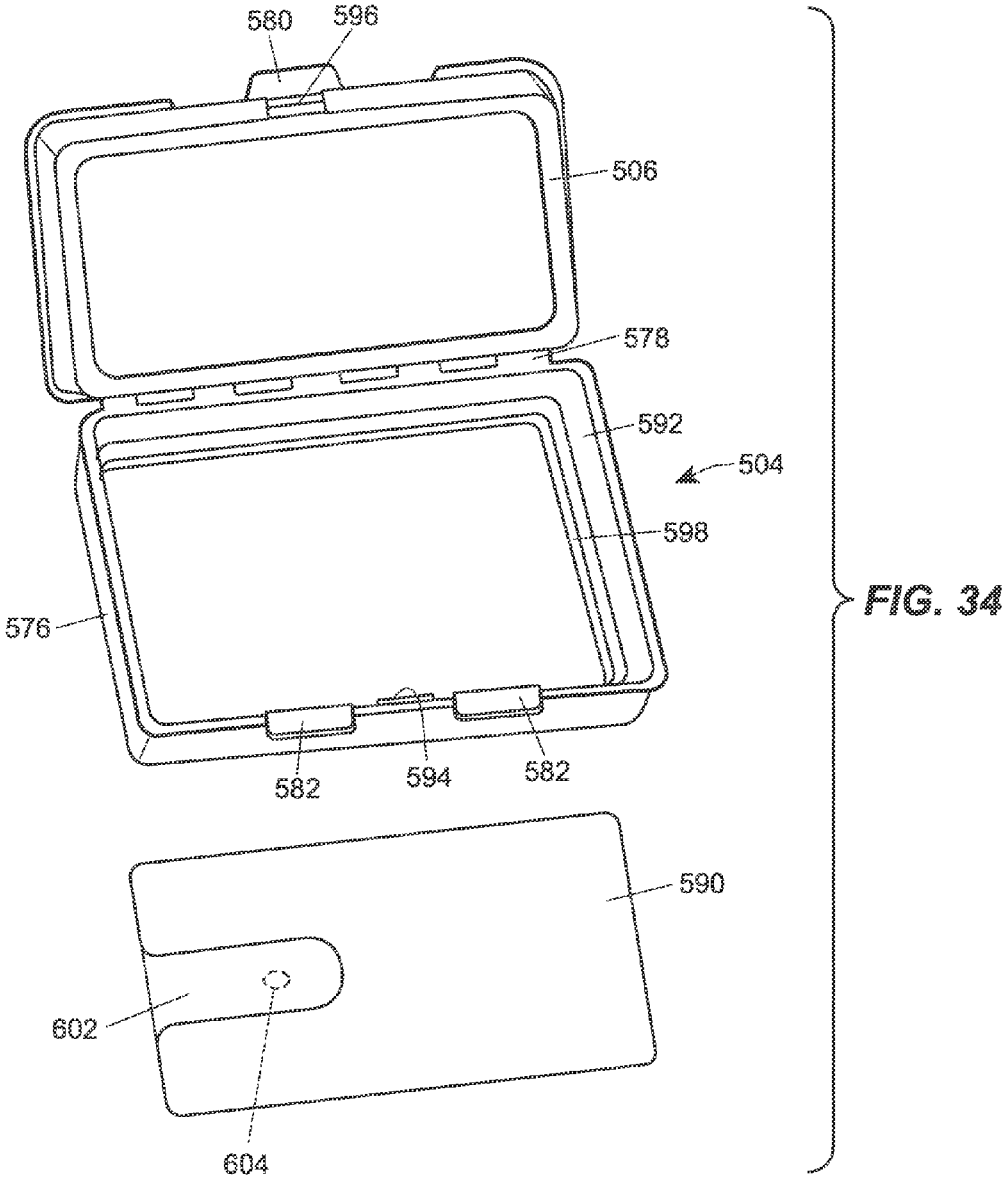
FIG. 34 is an isometric view of the lid fitment of the flexible container of FIG. 32 with the lid open and a pull tab thereof detached.

With the absence of a top side of the sheet of film in the present embodiment, it may be necessary to provide an additional sealing mechanism to the container 550 to provide additional sealing of the container 550, and retention of the product therein and, if necessary, tamper evidence prior to purchase of the product by the consumer. To provide the additional level of sealing, the container 550 may include an additional cover at the opening of the lid fitment 504 that is present when the lid 506 is open. FIG. 34 is an exploded view of an embodiment of the lid fitment 504 and a cover 590 that may be provided to seal the container 550 at the time the container 550 is assembled. The lid fitment 504 is shown with the lid 506 opened to expose the interior of the lid fitment 504 and its base 576. The base 576 includes an inner surface 592 having a shape that is complimentary to the shape of the lid 506. The inner surface 592 may include a first locking member 594 that mates with or otherwise engages a corresponding second locking member 596 of the lid 506 to hold the lid 506 closed when the lid 506 is rotated to the closed position and pressed down onto the base 576. The inner surface 592 may further define an inwardly extending shoulder 598 defining the opening of the base 576 through which access to the interior of the container 550 is provided.

Figure 35:
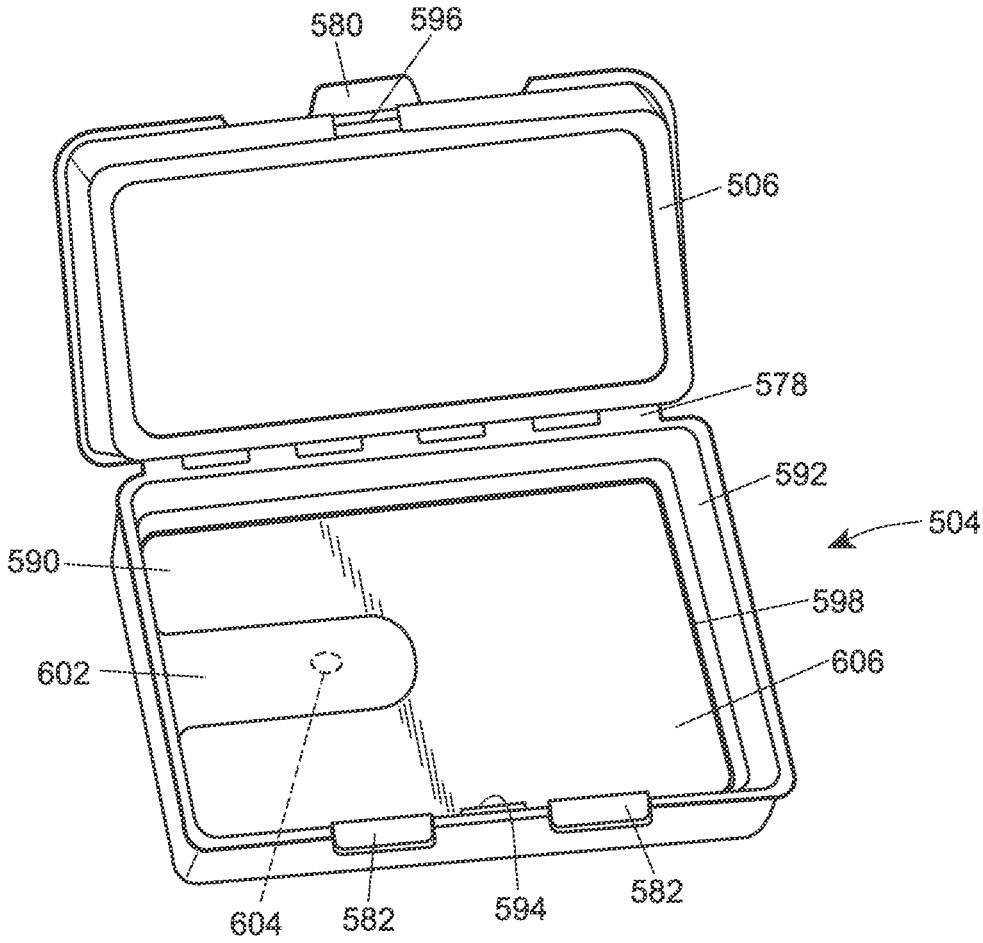
FIG. 35 is an isometric view of the lid fitment of the flexible container of FIG. 32 with the lid open and a pull tab thereof attached.

The cover 590 may be a generally flat sheet of material that is sized and shaped in a complimentary manner to the inner surface 592 of the base 576 and the shoulder 598. The cover 590 may be fabricated from the same material as the sheet of film from which the package 552 is formed, or may be formed from any other appropriate material that may be secured to the lid fitment 504 to seal the container 550. In the illustrated embodiment, the cover 590 is a flexible sheet of material that overlays the opening of the base 576 and will be secured to the inner surface 592 of the base 576. As shown in FIG. 35, the cover 590 may be inserted into the base 576 and rest on the shoulder 598 of the base 576. The cover 590 may be attached to the base 576 by forming a seal 606 using any appropriate sealing method such as those discussed above. Alternatively, the cover 590 may be secured to the base 576 with an appropriate adhesive to form the desired seal between the cover 590 and base 576. The cover 590 may include a tab 602 that may be held down by a tack seal area 604 that may be grasped by the consumer to pull upwardly on the cover 590 and separate the cover 590 from the base 576. The seal 606 or adhesive attachment of the cover 590 to the base 576 of the lid fitment 504 may have the necessary strength to seal the container 550 and retain the product therein, but to allow the consumer to detach the cover 590 from the base 576 to provide access to the interior of the container 550 when a sufficient upward force is applied to the tab 602 and, consequently, the cover 590.

Other configurations of the cover 590 are contemplated by the inventors and will be apparent to those skilled in the art. For example, the easy-opening features shown in FIGS. 15-19 may be adapted for use with the lid fitment 504 in the container 550. In those embodiments, the portion of the film sheet identified as the top side 42 may be shaped in a manner that is complimentary to the shape of the inner surface 592 of the base 576. The shaped film sheet may then be attached proximate the outer edges to the inner surface 592 by a seal or other bond having sufficient strength so that the flaps 22 may detach from the film sheets at the perforations 20 before the film sheets will detach from the base 576 of the lid fitment 504. It will also be apparent to those skilled in the art that the lid 506, the base 576 and the cover 590 or other film sheet that will be disposed between the lid 506 and the base 576 are configured so that the lid 506 may be closed down upon the base 576 and retained there by the engagement of the locking members 594, 596. In most implementations, the lid fitment 504 and the cover 590 or other film sheet may be prefabricated prior to the process of forming the package 552 and attaching the fitments 504, 512 thereto. However, prefabrication of the lid fitment 504 and cover 590 assembly is not essential, and the cover 590 may be attached to the lid fitment 504 at the time the container 550 is assembled and filled with the product or even after filling.

Figure 36:
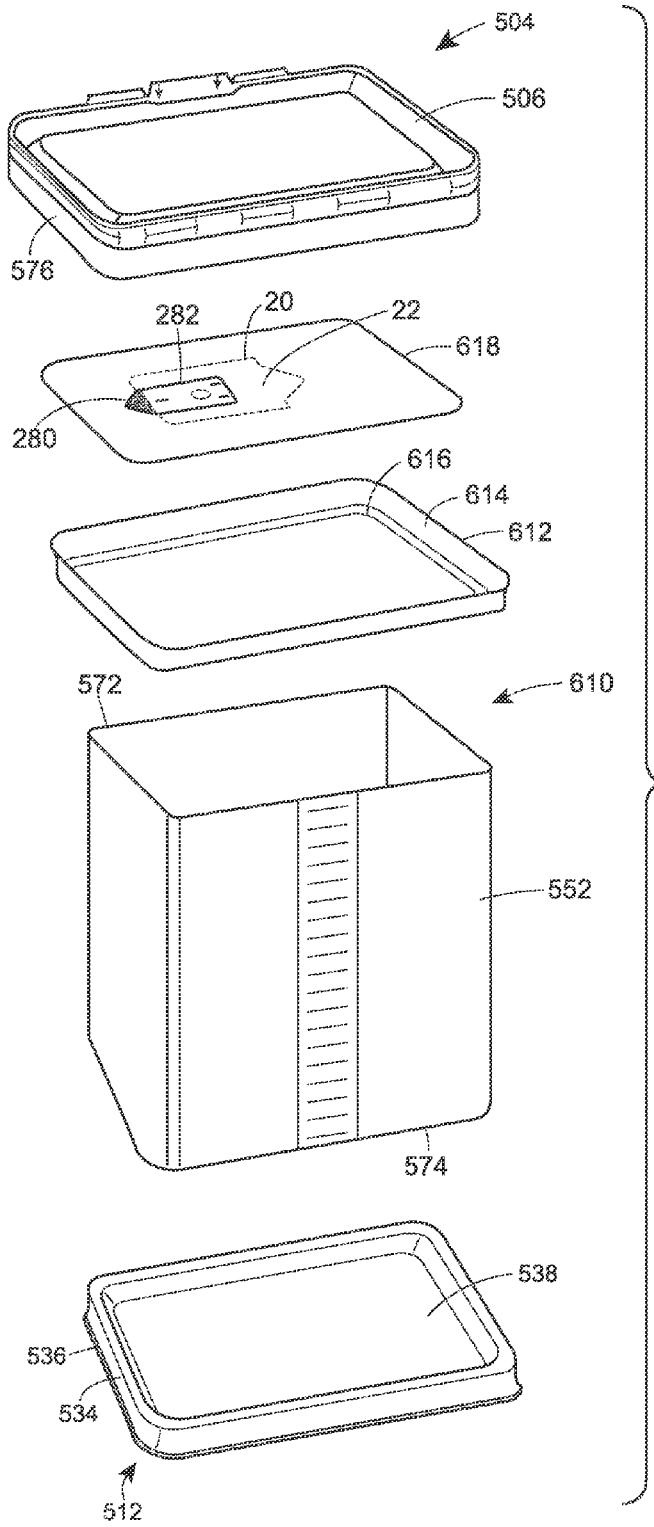
FIG. 36 is an exploded isometric view of a still further alternative embodiment of a flexible, stackable container in accordance with the present disclosure.

In a further alternative embodiment of a flexible, stackable container 610 shown in the exploded view of FIG. 36, an additional reinforcement ring 612 may be used to provide additional support to the package 552 as the container 610 is fabricated and filled with the product. Depending on the characteristics of the sheet of film from which the package 552 is formed, the package 552 may tend to collapse inwardly upon itself before the product is deposited therein. In such cases, the bottom fitment 512 may be attached at the bottom edge 574 and the reinforcement ring 612 may be attached at the top edge 572 to hold the package 552 in the desired shape prior to depositing the product therein. The reinforcement ring 612 may have a similar configuration as the base 576 of the lid fitment 504 as described above, including an inner surface 614 having a shape that is complimentary to the shape of the base 576, and further defining an inwardly extending shoulder 616 defining an opening of the ring 612 through which access to the interior of the container 610 is provided. A cover 618 having a shape that is complimentary to the shape of the inner surface 614 may provide the necessary closure of the package 610 prior to opening by the consumer. The cover 618 as illustrated is configured in a similar manner as the easy-opening feature of FIGS. 16*a*-16*c*, but other appropriate configurations of a cover having an easy-opening feature such as those described above are contemplated. After the bottom fitment 512 and reinforcement ring 612 are attached to the package 552 and the product is deposited in the package 552, the cover 618 may be lowered onto the reinforcement ring 612 and the outer edges of the cover 618 may be sealed to the inner surface 614 of the ring 612. With the cover 618 attached to the ring 612, the lid fitment 504 may then be inserted into the reinforcement ring 612 and attached to the inner surface 614 of the ring to complete the assembly of the container 610. If necessary to provide additional sealing of the cover 618, the base 576 of the lid fitment 504 may attached to an upper surface of the cover 618, such as with an adhesive or other appropriate sealing mechanism.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A flexible, stackable container for storing a quantity of a product, comprising:

a sealed package, the sealed package comprising:

oppositely disposed first and second panels, the first panel having a first planar surface and the second panel having a second planar surface;

an opening for accessing an interior of the package, wherein the opening is defined in the first panel;

at least one corner seal extending outwardly from the first planar surface in a substantially perpendicular direction, wherein the at least one corner seal surrounds more than two peripheral sides of the first panel of the package;

oppositely disposed front and rear panels;

oppositely disposed first and second lateral sides;

a leading seal extending outwardly from the first lateral side, the leading seal being folded over and secured to an outer surface of the package at the first lateral side such that a planar surface of the leading seal is disposed substantially parallel to a planar surface of the first lateral side; and a trailing seal extending outwardly from the second lateral side, the trailing seal being folded over and secured to an outer surface of the package at the second lateral side such that a planar surface of the trailing seal is disposed substantially parallel to a planar surface of the second lateral side;

wherein:

the package is formed from a single sheet of film having oppositely disposed lateral edges and oppositely disposed leading and trailing edges, first and second portions of the leading edge are joined by the leading seal, first and second portions of the trailing edge are joined by the trailing seal, two peripheral sides of the first panel are tucked inwardly towards the interior of the package and the two peripheral sides are at least partially covered by the leading seal and trailing seal, the oppositely disposed lateral edges of the single sheet of film are joined together at an end seal disposed within the second panel, peripheral sides of the first and second lateral sides proximate the second panel are tucked inwardly towards the second panel, the end seal is folded over towards an outer surface of the package at the second panel such that the end seal is disposed substantially in the plane of the second panel and at least partially covers the peripheral sides of the first and second lateral sides, and the interior of the package is sealed when the end seal, the leading seal, and the trailing seal are formed.

2. The flexible, stackable container of claim 1, wherein the package is hermetically sealed to retain the product disposed therein.

3. The flexible, stackable container of claim 1, wherein the second panel is substantially flat.

4. The flexible, stackable container of claim 1, wherein the opening comprises a flap defined in a portion of the first panel by a line of reduced strength in the film forming the first panel such that the line of reduced strength yields to separate the flap from a remaining portion of the first panel when a force is applied to the first panel.

5. The flexible, stackable container of claim 4, comprising a pull tab attached to the outer surface of the flap and having a gripping portion that is grasped by a user, wherein the pull tab is attached to the flap such that the flap detaches from the film along the line of reduced strength before the pull tab detaches from the flap when the gripping portion is pulled by a user.

6. The flexible, stackable container of claim 4, wherein the flap is a reclosable flap, adapted to reseal the flap to the remaining portion of the first panel.

7. The flexible, stackable container of claim 1, further comprising a lid fitment that:

(i) is attached to the first panel of the package, (ii) has a base having a central opening, and (iii) has a lid that has a shape that is complimentary to the shape of the base and seals when the lid is down onto the base, wherein a portion of the first panel of the package is accessible from the exterior of the container when the lid is separated from the base of the lid fitment.

8. The flexible, stackable container of claim 7, wherein the lid fitment comprises a living hinge connecting the lid to the base.

9. The flexible, stackable container of claim 7, wherein the base of the lid fitment is sealed to the at least one corner seal surrounding the first panel.

10. The flexible, stackable container of claim 7, wherein the base of the lid fitment has a bottom surface surrounding the central opening of the base, and wherein the bottom surface of the base is sealed to the first panel.

11. The flexible, stackable container of claim 7, wherein the lid of the lid fitment comprises an outer wall extending around the perimeter of the lid and having an upper edge, and a central raised portion within the outer wall extending upwardly and having a top panel.

* * * * *